US005605482A

United States Patent [19]

Choy

[11] Patent Number: 5,605,482

[45] Date of Patent: Feb. 25, 1997

[54] INFLATABLE FLOTATION DEVICES

[76] Inventor: Fuk C. A. Choy, 10 Howard, Campbellton N.B., Canada, E3N 2R9

[21] Appl. No.: 521,093

[22] Filed: Aug. 29, 1995

[51] Int. Cl.[6] ..... B63C 9/08

[52] U.S. Cl. ..... 441/106

[58] Field of Search ..... 441/9, 10, 41, 441/92, 93–101, 106–119; 222/5; 169/42, 58

[56] References Cited

U.S. PATENT DOCUMENTS

| | | | |
|---|---|---|---|
| 4,523,914 | 6/1985 | Faulconer et al. | 441/108 |
| 4,968,277 | 11/1990 | Parish et al. | 441/93 |
| 5,419,725 | 5/1995 | Crowder et al. | 441/41 |

FOREIGN PATENT DOCUMENTS 1110502 10/1981 Canada .

1215272 12/1986 Canada .

*Primary Examiner*—Jesus D. Sotelo

*Attorney, Agent, or Firm*—Ronald S. Kosie; Robert Brouillette

[57] ABSTRACT

An inflation system for the inflation of an inflatable flotation device wherein a gas is chargeable into a gas inflatable chamber, from a gas vessel containing compressed gas, so as to form a floatable body. The inflation system initiates or triggers the inflation of such a device by taking advantage of a pressure responsive activation mechanism; the system may additionally or alternatively exploit an electrically breakable filament trigger to initiate inflation. The flotation device may be a personal flotation device in the form, for example, of a flotation vest or it may be a flotation device such as an inflatable dingy, buoy and the like.

14 Claims, 13 Drawing Sheets

FIG. 8
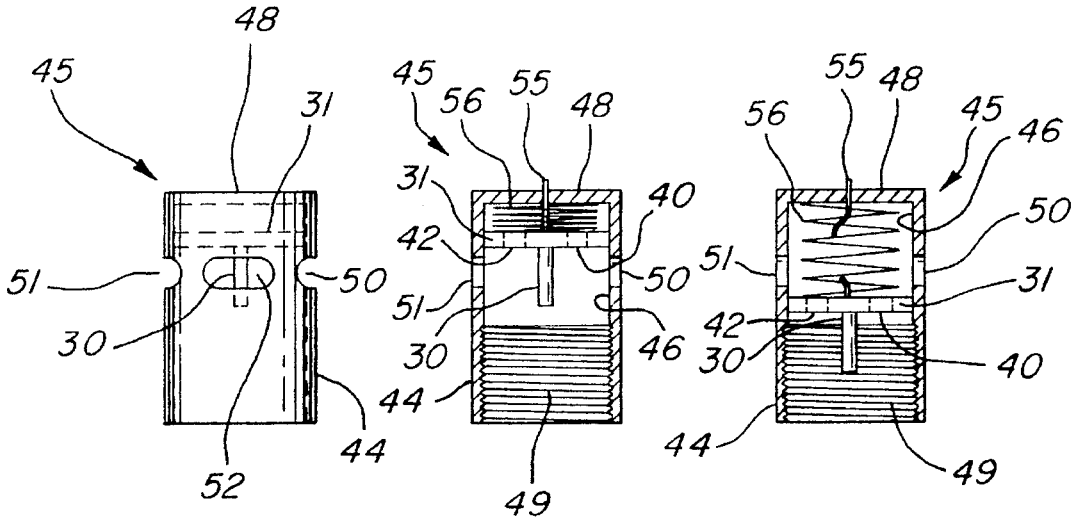
FIG. 7
FIG. 9
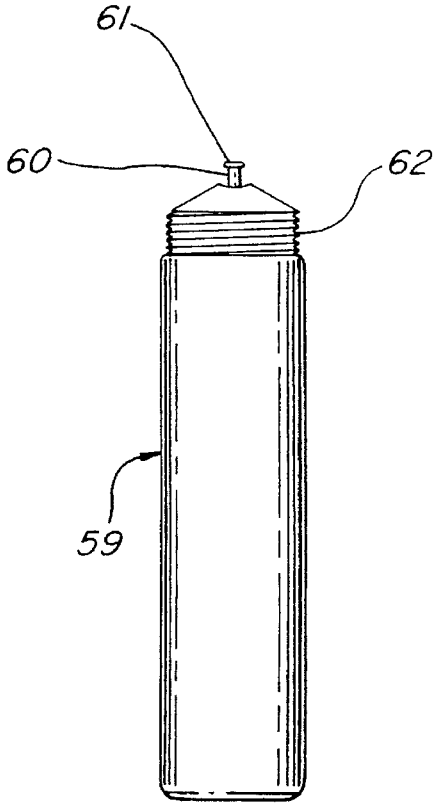
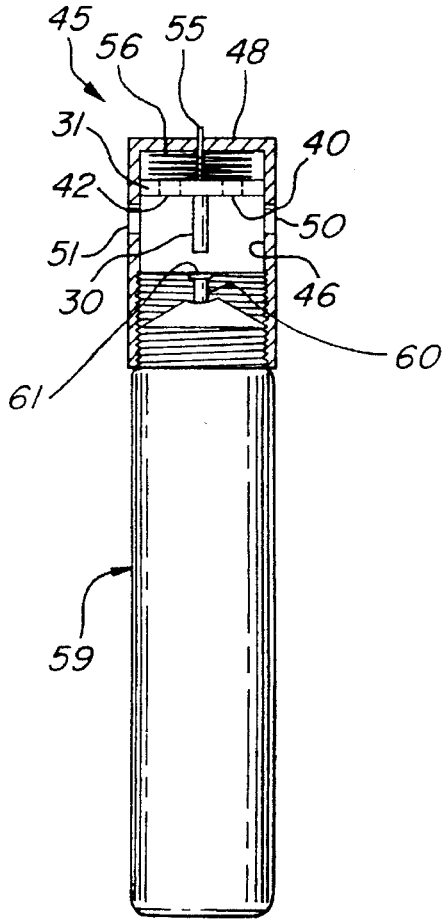
FIG. 10
FIG. 11

INFLATABLE FLOTATION DEVICES

The present invention relates to inflatable flotation devices such as for example lifesaving jackets, vests, belts and the like. The invention in particular relates to flotation devices wherein a gas may charged into an inflatable gas tight chamber or a plurality of such chambers for forming a floating body, such charging being initiated manually and/or automatically.

Gas inflatable flotation devices are known.

It is known for example to provide flotation devices with a gas charging device capable of inflating or expanding a bladder(s) so as to form a floatable body. It is known for example to break the seal of a high pressure gas cartridge or bomb so as to release the gas therein, the so released gas being directed to an inflatable flotation chamber(s) so as to expand the chamber(s) and form a floatation body.

Various means are known whereby the seal of a gas cartridge may be breached so as to release the gas therein. It is known for example to use some type of electric circuit to fire a detonator so as to plunge a pin into a sealing plate of a high pressure gas cartridge or bomb so as to release the gas therein.

Non detonator type mechanisms are also known wherein a cord may be used to retain a pin arm in place against a spring bias; the cord is breached by heating it with a resistor.

A spring bias system is shown in U.S. Pat. No. 4,968,277; this reference indicates that the retaining cord may be one which is of a material which readily burns or melts when heat is applied. This system applies an indirect method for breaking the retaining member. The problem associated with the use of such cord type materials, however, is that the material may effectively stretch instead of immediately being severed with the result that the force with which the pin may hit the cartridge seal may not be great enough to rupture the seal and allow the gas to escape therefrom. There may also be a significant time lag between the time the device is activated for inflation and when inflation actually occurs; this time lag could put a user at risk in situations where any such delay may be life threatening.

Gas inflatable flotation devices such as life jackets may not be comfortable to wear when in an inflated state. The inflated volume of a lifesaving jacket or vest may be greatly different from the non-inflated configuration. An inflated jacket may thus restrain or even compress the chest of a user to the point where the vest may even interfere with the breathing of the wearer and thus add to the difficulties of a wearer who may already be in a state of great stress due to being involuntarily found in a deep body of water.

It would be advantageous to have an inflation activation system for inflating an inflatable flotation device wherein a retaining member would be directly connected to an electric circuit so as to be able to more or less snap apart the retaining member once the system is activated.

It would be advantageous to have an inflation activation system which could be manually activated or be activated automatically due to a predetermined pressure (e.g. water pressure) being exerted on the activation system.

It would be advantageous to have a pressure activatable inflation system wherein the pressure necessary to initiate inflation may be varied.

It would further be advantageous to have an inflatable personal flotation device which could avoid or minimize the restraining or compressing of the chest of a wearer when the device is inflated so as to minimize any interference with the inhalation of air by the wearer.

The present invention generally relates to inflatable flotation devices and to activation systems which may be used for initiating or triggering the inflation of such devices. These devices and systems may for example take advantage of an electrically breakable filament trigger and/or pressure responsive activation mechanisms.

The flotation device may be a personal flotation device in the form, for example, of a flotation vest or jacket; alternatively, it may be a flotation device such as an inflatable dingy, buoy and the like.

In accordance with an aspect of the present invention there is provided an inflation activation system for the inflation of an inflatable flotation device wherein a gas is chargeable into a gas inflatable chamber, from a gas vessel containing compressed gas, so as to form a floatable body, said inflation activation system comprising a housing defining a water tight interior, and pressure responsive activation means for activating a gas inflation component for the inflation of a gas inflatable chamber, said pressure activation means being disposed in said water tight interior, said housing having a pressure displaceable wall member having a first configuration wherein said pressure displaceable wall member is disposed a predetermined distance from said pressure responsive activation means, said pressure displaceable wall member and said pressure responsive activation means being disposed and configured such that a predetermined exterior pressure is able to displace the pressure displaceable wall member from said first configuration to an activation configuration whereby the pressure displaceable wall member engages said pressure responsive activation means so as to activate said gas inflation component for the inflation of said gas inflatable chamber.

In accordance with the present invention the above described inflation activation system may, for example, comprise a water resistant electric circuit component, said electric circuit component comprising power supply means for supplying electric power to said circuit, and an above described pressure responsive activation means, said pressure activation means comprising a pressure responsive electric switch component comprising a switch, said switch component being configured such that a predetermined pressure is able to displace the switch between an open configuration wherein electric current is not able to flow through said circuit and a closed configuration wherein electric current is able to flow through said circuit, said gas inflation component being configured so as to be activatable when electric current is able to flow through said circuit, said pressure displaceable wall member and said switch being disposed and configured such that a predetermined exterior pressure is able to displace said pressure displaceable wall member from said first configuration to an activation configuration whereby the pressure displaceable wall member engages and displaces the switch from said open to said closed configuration thereof.

The above described system may for example be used with known inflation systems such as described above.

In accordance with a further aspect of the present invention there is provided, a trigger device comprising an anchor component, an alignment component, an activation pin member displaceable between an armed position and a released position, a trigger filament fixed to said anchor component and to said activation pin member for releaseably maintaining said activation pin member in said armed position, and a biasing component for maintaining said trigger filament under tension when said activation pin member is in said armed position, said biasing component engaging said activation pin member, said alignment component being configured to guide said activation pin member from said armed position to said released position, said trigger filament being configured and disposed so as to be able to define a portion of an electric circuit such that when said trigger filament is maintained under tension in said armed position by said biasing component a predetermined electric current passing therethrough will cause the trigger filament to snap-break, said alignment component and said biasing component being configured and disposed such that when said trigger filament is broken by passage of said electric current therethrough said biasing component is able to urge said activation pin member to said released position.

The trigger device may be used in an inflation system for the initiating the inflation of an inflatable flotation device. The trigger device may, for example, be used with known inflation systems such as described above.

In accordance with the present invention the trigger filament may be configured and disposed in any manner suitable for defining a portion of an electric circuit such that a predetermined electric current passing therethrough will cause the filament to snap-break. The trigger filament may comprise any suitable material which is able to provide a filament, which while under tension, is able to snap-break (i.e. break suddenly) on the passage of a predetermined electric current passing therethrough. The trigger filament must also have sufficient tensile strength so as to be able to hold the trigger device in an armed position until such time as the current is passed therethrough (e.g. a rupture tension of 23 newtons or more). The current necessary to snap-break any particular filament may be predetermined by any suitable means which can place the filament under the tension which is needed in order to trigger the escape of gas from a suitably arranged gas cartridge. The current will of course vary from material to material as well as with the cross-sectional area of the filament, etc.. The trigger filament may be a metallic filament; it may for example comprise a tungsten filament.

In accordance with the present invention, the biasing component may be configured in any suitable fashion. Thus such biasing may, be achieved in any fashion, directly or indirectly, as long as the result is that the activation pin member may be urged to the above mentioned released position. The biasing component may, for example, directly engage the anchor component and indirectly engage activation pin member, i.e. such that the biasing component disposed between these other members tends to push these members apart. Alternatively, the biasing component may, for example, engage a housing, the anchor component being fixed to the housing such that the biasing component tends to pull rather than push the activation pin member away from the anchor component.

In accordance with the present invention the alignment component may take on any suitable form; it may comprise a single element or it may comprise two or more elements working together for the common end, namely the guidance of the pin member to the released position.

In accordance with an additional aspect the present invention provides an inflation system for the inflation of an inflatable flotation device wherein a gas is chargeable into a gas inflatable chamber, from a gas vessel containing compressed gas, so as to form a floatable body, said inflation system comprising a gas inflation component, a gas inflatable chamber component, and a water resistant electric circuit component, said electric circuit component comprising power supply means for supplying electric power to said circuit, and a pressure responsive electric switch component comprising a switch, said switch component being configured such that a predetermined pressure is able to displace the switch between an open configuration wherein electric current is not able to flow through said circuit and a closed configuration wherein electric current is able to flow through said circuit, said gas inflation component comprising a trigger device, a gas vessel containing compressed gas, a gas communication member for gas communication between said gas vessel and said gas inflatable chamber component, said gas communication member comprising a valve having a valve core displaceable between a valve open position and a valve closed position, said valve core being biased in said valve closed position, said trigger device comprising an anchor component, an alignment component, an activation pin member displaceable between an armed position and a released position, and a tensioned trigger filament fixed to said anchor component and to said activation pin member releaseably maintaining said activation pin member in said armed position, said alignment component being configured to guide said activation pin member from said armed position to said released position, said trigger filament being maintained under tension by a biasing component engaging said activation pin member, said trigger filament defining a portion of said electric circuit component such that a predetermined electric current passing therethrough will cause the filament to snap-break, said alignment component and said biasing component being configured and disposed such that when said trigger filament is broken by passage of said electric current therethrough said biasing component is able to urge said activation pin member to said released position whereby said activation pin element engages and displaces said valve core from said valve closed position to said valve open position so as to release said gas from said vessel for inflation of said gas inflatable chamber component.

An inflation system in accordance with the present invention may be used with one, two, three or more compressed gas vessels or cartridges; one, two, three or more inflatable chambers; one, two, three or more trigger devices; etc.

The power supply means may take on any suitable or necessary configuration. The power supply means may for example comprise battery seating means for releasably seating removable batteries; the systems or devices herein can thus for example be initially sold without such batteries which could be put in place by the user. The battery seat means may be of a type whereby one, two, three or more battery cells may be seated in place. Alternatively the batteries may be permanently fixed in place. The batteries may be of rechargeable type. The battery cells are, however, to be chosen on the basis of the amount of current needed to snap-break a particular trigger filament; the batteries may for example comprise one or more 9 v batteries, one or more AA batteries, etc. If desired, the batteries may be housed in a separate water tight housing or in the same housing as the pressure responsive switch.

In accordance with a particular embodiment of the present invention an inflation system as described herein may, as mentioned above, comprise a housing defining a water tight interior wherein a pressure responsive switch is disposed in the water tight interior.

The housing may, for example, have a pressure displaceable wall member having a first configuration wherein the pressure displaceable wall member is disposed a predetermined distance from said switch; the pressure displaceable wall member and the switch may be disposed and configured such that a predetermined exterior pressure is able to displace the pressure displaceable wall member from said first configuration to an activation configuration whereby the pressure displaceable wall member engages and displaces the switch from said open to said closed configuration thereof.

In accordance with a further embodiment of the present invention, an inflation system as described herein may include a spacing component for altering said predetermined distance between the pressure displaceable wall member and the switch.

The spacing component for altering the aforesaid predetermined distance may take any desired or suitable form. Thus for example, the switch may be fixed to a platform member, and said spacing component may comprise a stem element of variable length fixed to said housing. The stem element may have a displaceable engagement member which forms part of said wall component and which engages (directly or indirectly) the platform member. The stem element may take on any desired form provided that it is configured such that an increase in the length of the stem member will induce a corresponding reduction of said predetermined distance and a decrease in the length of the stem element will induce a corresponding increase of said predetermined distance, i.e. the stem member may have a telescoping like character.

In accordance with a particular embodiment of the present invention the stem element may comprise an extension element and a base element, said extension element and said base element being disposed outside of said water tight interior, said base element being fixed to said housing, said base element comprising an opening extending therethrough, said opening being provided with an internal screw thread, said extension element comprising a head element and a shaft element, said shaft element having an external screw thread for rotatable engagement with said internal screw thread, said extension element and said base element being disposed and configured such that said head element engages said engagement member such that said displaceable engagement member is disposed between said head element and said platform member.

The spacing component device in this case includes means for rotation of said extension element, relative to said base element, whereby the length of said stem member may be increased or decreased.

In accordance with the present invention a depth gradient may be disposed about the above mentioned threaded opening engaging the shaft element. A pointer marking may also be disposed on the exposed end of the stem shaft. The gradient and pointer marking are configured such that the disposition of the pointer relative to the gradient is indicative of the depth at which the system will automatically induce inflation of the flotation chambers; essentially the depth gradient will correspond to a specific distance between the switch and the pressure displaceable wall member. With such a gradient a user may alter the factory set depth setting to a setting of choice.

In accordance with another aspect of the present invention there is provided an inflatable personal flotation device comprising a vest comprising two or more gas inflatable bladder members connected together by respective flexible expansion connection members for allowing, when said bladders are gas inflated, said vest to expand and contract, about the chest of a person wearing the inflated vest, in synchronization with the person's breathing, and gas inflation means for inflating said bladder members with a gas. The gas inflation means may be as described herein or it may take the form of any other type of inflation means including for example, a manual type whereby the bladders are inflated by a person's breathe or an air pump.

It is to be understood herein that a reference to "a water resistant electric circuit component" is reference to an electric circuit component which is able to function in the presence of water (e.g. if the component is immersed in water) for activation of the gas inflation component; a switch and power supply may, for example, be disposed in a suitable water tight housing which can be immersed into water such that the switch and power supply may still carry out their function.

It is to be understood herein that a reference to "an exterior pressure" is reference to a pressure exerted from, for example, the outside of a water-proof housing in which a pressure responsive switch is disposed.

An inflation system as described herein may, for example, advantageously be used for lifejackets. A lifejacket, for example, may be equipped with the inflation system which has been prearranged so as to activate once a given exterior water pressure has been achieved (i.e. once the wearer has passed to a predetermined depth of water). The pressure sensitivity of the inflation may, for example, be manipulated by varying the distance between the pressure displaceable wall member and the pressure sensitive switch. The inflation activation will occur automatically such that if a wearer should for any reason (e.g. due to unconsciousness, panic, etc.) not be able to activate the inflation of the lifejacket, the pressure activation mechanism will do so for the wearer.

An inflation system as described herein may also, for example, advantageously be used for lifejackets intended for children, handicapped persons, or other persons of limited physical strength. Lifejackets for such persons may be provided with a pressure responsive activation mechanism which has been previously adjusted so that the pressure needed to cause manual activation will fall within their capacity to activate; in this case if such a person feels threatened with drowning the person would manually (e.g. press or hit) the pressure displaceable wall area to activate the inflation component of the lifejacket.

A pressure responsive wall member may be made of any (known) suitable material able to be displaced by pressure; it may for example be made of a rubber material, a vinyl material, a nylon material and the like.

A pressure responsive switch may comprise any known suitable switching device which can for example close an electric circuit so as to allow an electric current to flow through a circuit configured to cooperate with an inflation device such that the flow of current through the circuit triggers or activates the inflation device so as to inflate a flotation chamber(s) or bladder(s). The switch may for example be of a type which may be able to pass back and forth between an open and closed configuration. The switch may, however, advantageously be of a kind whereby it will lock in a closed configuration once it is displaced to the closed configuration; this type of switch will, for example, avoid the possibility that a person in distress in water may as a result of panic hit the switching device repeatedly with the consequence that the inflation of a flotation chamber may be stopped or be interrupted before a flotation chamber is fully inflated.

In Drawings which illustrate example embodiments of the present invention:

FIG. 7 is a schematic side view of an example embodiment of an activation or trigger device in accordance with the present invention;

FIG. 8 is a schematic sectional side view of the activation device of FIG. 7 with the moveable pin member thereof in an armed position;

FIG. 9 is a schematic sectional side view of the activation device of FIG. 7 with the moveable pin member thereof in a released position;

FIG. 10 is a schematic side view of a gas vessel containing compressed gas;

FIG. 11 is a schematic side view of a gas vessel of FIG. 10 to which an activation device of FIG. 7 has been attached, the moveable pin member thereof being in an armed position;

Figure 1:
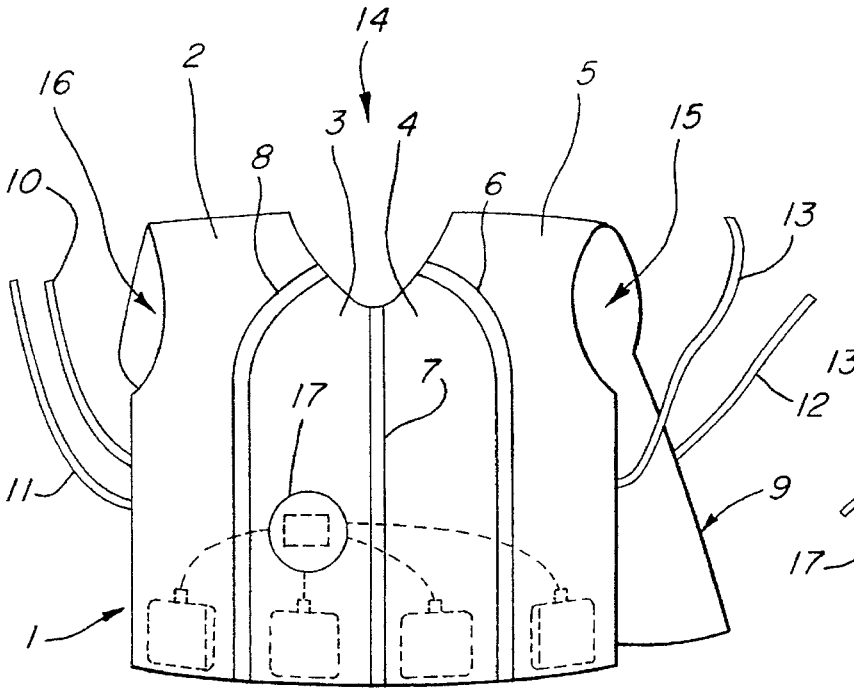
FIG. 1 is a schematic front view of the front panel of a personal flotation device which as shown takes the form of an inflatable vest.

Referring to FIG. 1, shows an inflatable vest having a front or chest panel 1 which is able to expand and contract following the breathing of a user. The vest chest panel 1 has four inflatable gas tight chambers or bladders 2, 3, 4 and 5;

if desired, the chest panel could, for example, alternatively comprise a single discrete bladder but in this case the front panel would not be of a kind which is expandable with the breathing of a user. Adjacent chambers are spaced apart from one another by expansion connection members 6, 7 and 8; these connection members are flexible for reasons as shall be explained below. For purposes of illustration, the back panel 9 of the vest is not provided with similar bladders; the back panel may of course be configured in the same or analogous way as the front or chest panel.

The expandable vest is provided with tie members 10, 11, 12 and 13. There is also a head opening 14 and shoulder openings 15 and 16. Once the head of a wearer is passed through the opening 14 the tie members 10 and 11 are tied together under the arm of the wearer; the tie members 12 and 13 are also similarly tied together. The vest could of course use any other type of suitable fixation means to fix the front and back panels together; a Velcro (i.e. hook and mat) type fastener system; a clamp type fastener, a latch type fastener and the like.

The breathing expandable vest could also take any other suitable or conventional overall form provided that the vest includes a plurality of chambers or bladders connected together by flexible expansion connection members, i.e. members which are configured and disposed such that when the bladders are gas inflated, the vest is able to expand and contract about the chest of a person wearing the inflated vest as the person breathes. In the embodiment shown in FIG. 1 the expansion connection members 6, 7 and 8 are illustrated as longitudinally extending expansion members; the expansion members could as desired be disposed horizontally or transversely with respect to the wearers upright standing position; the expansion connection members could criss-cross each other so as to form a plurality of diamond shaped bladders. In any case the disposition of the expansion connection members is to be selected keeping in mind their function.

Figure 2:
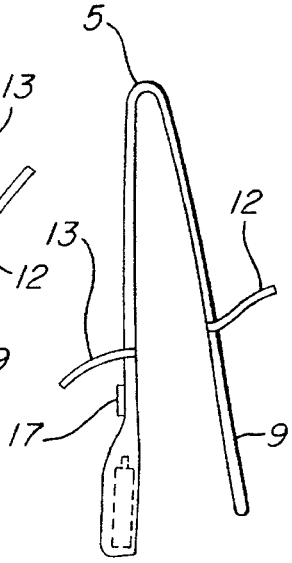
FIG. 2 is a side view of the front panel of FIG. 1.

FIG. 2 shows a side view of the vest of FIG. 1. The vest as shown in FIGS. 1 and 2 is in a non-inflated configuration. The gas inflatable chambers or bladders 2, 3, 4 and 5 may be inflated by a gas charging system comprising an activation mechanism 17 which is electrically connected to each of the trigger devices of a plurality of gas vessels or cartridges containing compressed gas; the cartridges are shown in dotted outline in the FIGS. 1 and 2.

In the embodiment, in FIGS. 1 and 2 shown each gas vessel or cartridge has a gas valve mechanism which is in gas communication with the interior of a respective chamber 2, 3 4 and 5, i.e. in the illustrated embodiment each of the cartridges including its respective valve is disposed within a respective non-inflated chamber; if desired the main body of each of the gas cartridges could of course be disposed outside of the bladders in which case appropriate tubing or the like gas communication means may be used to provide gas communication between the interior of a bladder and a respective gas valve. Particular embodiments of gas charging systems will be described below with respect to FIGS. 5 to 32.

Figure 3:
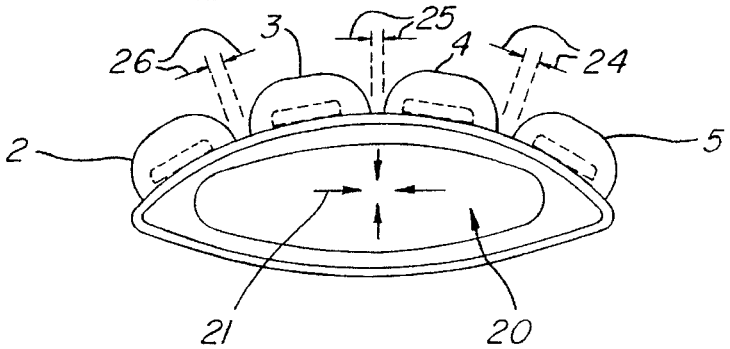
FIG. 3 is a bottom view of a vest including the front panel of FIG. 1 disposed about the chest of a person shown in sectional outline in a contracted configuration.
Figure 4:
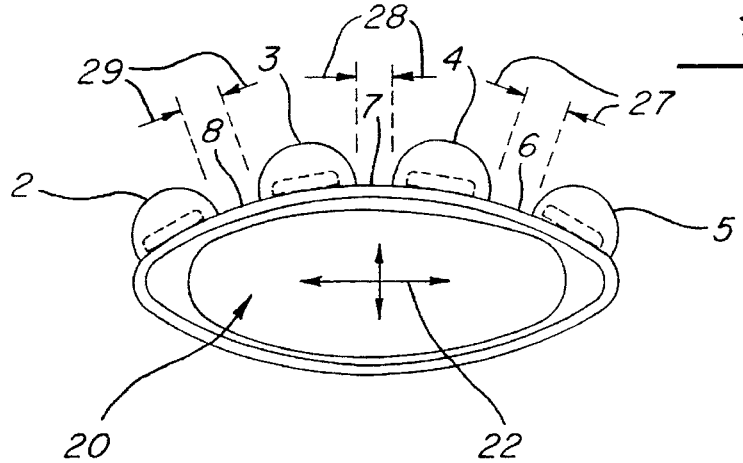
FIG. 4 is a bottom view of a vest including the front panel of FIG. 1 disposed about the chest of a person shown in sectional outline in an expanded configuration.

Turning to FIGS. 3 and 4, these figures show the vest of FIG. 1 in an inflated state as worn by a person whose chest cavity 20 is shown schematically in cross section. In FIG. 3 the chest cavity is shown in a collapsing configuration as indicated by the arrows one of which is designated with the reference numeral 21, i.e. the person is expelling air from the persons lungs. In FIG. 4 the chest cavity is shown in an expanding configuration as indicated by the arrows one of which is designated with the reference numeral 22, i.e. the person is inhaling air to the persons lungs. In FIG. 3 the flexible expansion members 6, 7 and 8 are in a retracted configuration as designated by spacing interval between bladders as identified by the respective arrows 24, 25 and 26. 0n the other hand in FIG. 4, the flexible expansion members are in a stretched configuration as designated by the larger spacing interval between bladders as identified by the respective arrows 27, 28 and 29. As may be seen from FIG. 3 and 4, the presence of the flexible expansion connection members allows the vest to follow the expansion and contraction of the persons lungs, i.e. the vest of the present invention does not interfere to the same degree with the breathing of the wearer than is the case if the bladders were connected together by some kind of inflexible connector. The flexible expansion connection members may be of any suitable material keeping in mind their use; the connection members may, for example, be of rubber like material (natural or man made).

As mentioned above FIGS. 5 to 18 relate to an example embodiment of a gas charging system for inflating an inflatable flotation device such as for example a lifesaver vest.

FIGS. 5 to 12 in particular illustrate, an example embodiment, of an activation device, which may be used to initiate the inflation of an inflatable flotation device, i.e. by being used to release gas from a gas cartridge.

Figure 5:
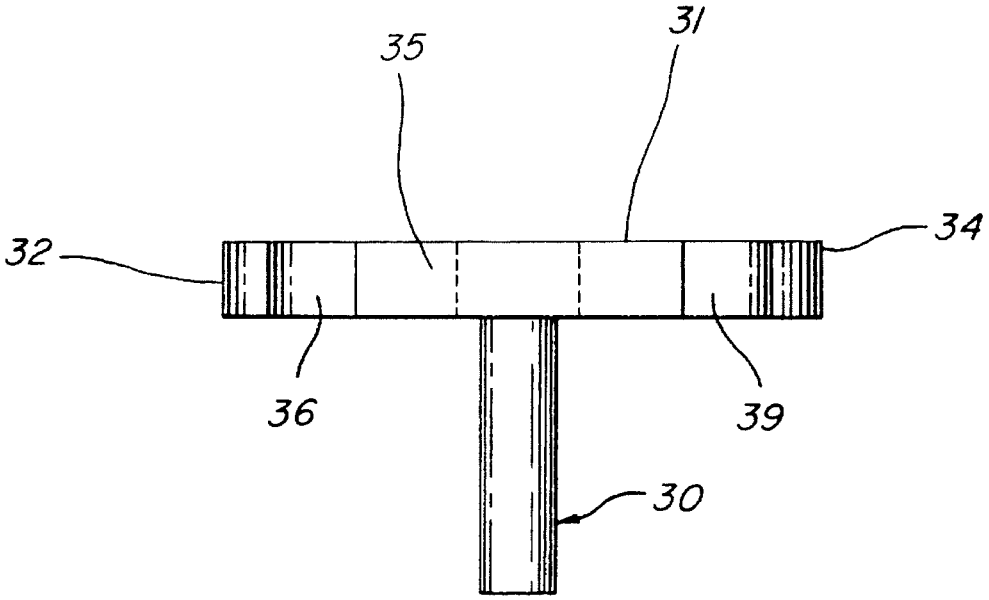
FIG. 5 is a side view of an example embodiment of an activation pin member attached to a capping alignment plate.
Figure 6:
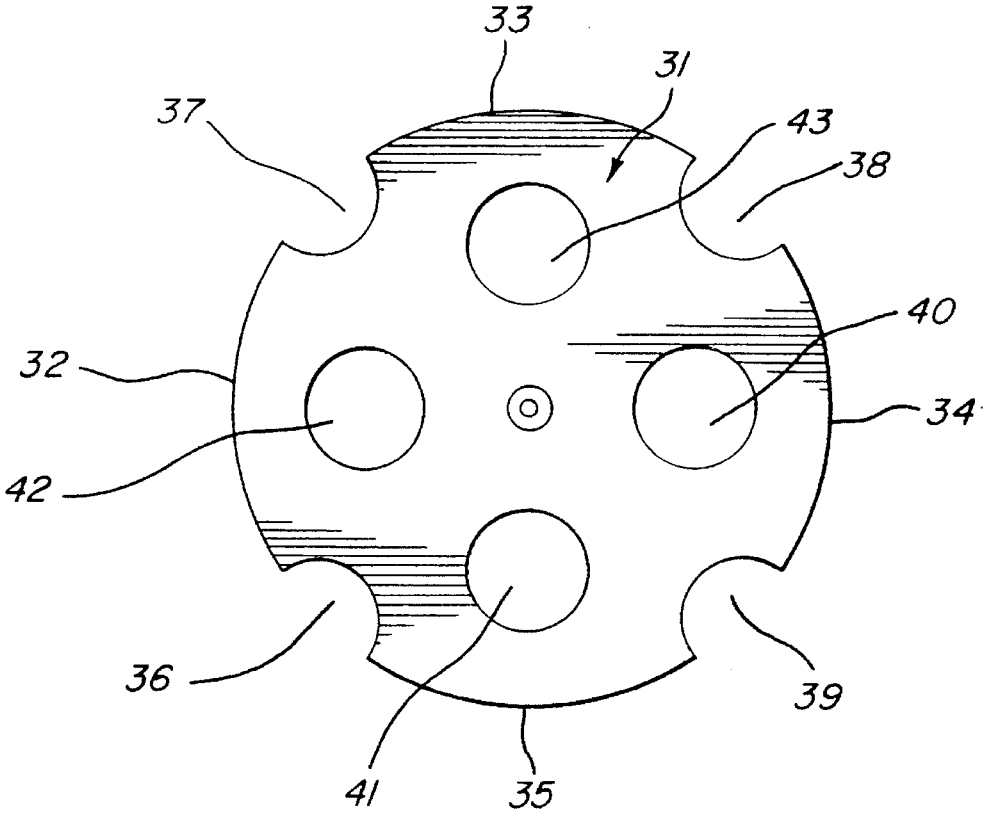
FIG. 6 is a top view of the alignment plate attached to the activation pin member of FIG. 5.

Referring to FIG. 5 and 6, these figures show an activation pin member 30.

The example activation pin member 30 is fixed to one part of a two part alignment means, namely cylindrical alignment plate 31. The pin 30 and plate 31 thus form a pin/plate combination. The plate 31 has lateral side walls 32, 33, 34 and 35 which are spaced apart by groove openings 36, 37, 38 and 39. The plate 31 also has openings 40, 41, 42 and 43 which extend therethrough. The openings in the plate 31, including the groove openings, are present to allow gas to escape through the plate 31 as shall be explained below.

The other element of the alignment means is the cylindrical wall member 44 of the trigger device or cap 45 (see FIGS. 7, 8 and 9). The cylindrical wall member 44 has an interior surface 46 which defines an interior cylindrical pocket. The above mentioned pin/plate combination is disposed in the pocket. As may be seen from FIGS. 8 and 9, the plate 31 and the cylindrical wall member 44 are sized and configured such that they may act together as a piston/cylinder type combination. The lateral side walls 32, 33, 34 and 35 slidably engage the interior surface 46 for linear displacement of the pin member 30 from the armed to the released position as shall be explained below, i.e. the lateral side walls slidingly engage the surface 46 such that the pin member is guided thereby to the released position.

The cap 45 is closed off at one end by a capping plate 48 and is provided with an internally threaded opening 49. The wall member 44 is also provided with side wall gas escape openings 50, 51 and 52; if so desired the plate 48 may also be provided with similar gas openings (see FIG. 30).

The trigger cap 45 is also provided with a retaining member 55 and a bias spring member 56. The retaining member 55 comprises the trigger filament as shall be explained below with respect to FIG. 14.

Turning to FIG. 8, this figure shows the trigger device or cap 45 in an armed configuration, i.e. a configuration wherein the trigger filament of the retaining member is in a tensioned armed configuration. Plate 31 is displaceable in a linear fashion away from the plate 48. These plates are maintained in an armed configuration by the retaining member 55. One end of the retaining member 55 is fixed to the capping plate 48 which acts as an anchor member; the other end of the retaining member 55 is fixed to the activation pin member 30 by being fixed to the top of the alignment plate 31. The spring bias member 56 is in a compressed configuration between the capping plate 48 and the alignment plate 31. The spring bias member is configured such that it is able to push against the plates 31 and 48 so as to tend to push these plates apart from each other; since the retaining member 55 is fixed to both of the plates, this tendency of the plates to move apart is countered by the presence of the retaining member 55. Thus the retaining member 55 is maintained in a tensioned state by the spring biasing member 56.

Although the trigger filament is shown in the FIG. 8 as being in a tensioned condition, the trigger filament may if desired (e.g. for storage purposes) be maintained in a non-tensioned, unbroken (i.e. unarmed) configuration up until such time as the trigger filament is desired to be put into a working state. An unarmed state may for example be maintained by a suitable releasable connector means (e.g. a releasable clamp or latch) attached to the plate 31 and another member (e.g. plate 48) such that the spring bias member 56 is compressed so that the filament is not under tension thereby; when it is desired to set the trigger to the armed position the connector means is released such that the filament is placed under the trigger tension. Alternatively, a removable wedge member may be passed through an opening in the wall member 44 such that the wedge member is disposed under the plate 31 so that the spring bias member 56 is compressed so that the filament is not under tension thereby; when it is desired to set the trigger to the armed position the wedge is removed from under the plate 31 such that the filament is placed under the trigger tension.

Turning to FIG. 9, this figure shows the trigger device or cap 45 in a released configuration. As may be seen, the retaining member 55 is split into two parts, i.e. the trigger filament thereof has previously been broken by the passage of an electric current therethrough, as shall be explained below. As may be appreciated once the trigger filament was broken there was nothing holding back the spring bias member 56 from urging the pin member to the released position shown.

FIG. 10 shows an example embodiment of a gas cartridge 59 containing compressed gas. The cartridge 59 has a valve system for the release of the pressurized gas. The valve system includes a displaceable valve core 60; only the top part 61 of core 60 is seen in FIG. 10. The valve core 60 in FIG. 10 is (spring biased) in a closed position such that gas may not leave the cartridge. The cartridge also has an externally threaded top part 62. The top part 62 of the cartridge 59 and the opening 49 of the cap 45 are configured and sized such that the top part 62 and the opening 49 can matingly engage such that the trigger cap 45 may be screwed in fluid tight fashion onto the top of the cartridge 59 as seen in FIGS. 11 and 12.

FIG. 11 shows the trigger cap 45 in its armed configuration. As seen, the pin member 30 is spaced apart from the valve top 61. The distance between the pin member 30 and the valve top 61 is such that when the pin member 30 is displaced to the released position the pin member 30 is able to displace the valve core 60 to a position wherein the valve system is open and gas can escape the cartridge 59, i.e. the valve core is displaceable to a valve open position. The pin member 30 could, if desired, abut valve top 61 provided that the bias member 56 can exert the necessary force to achieve a snap-breaking of the trigger filament followed by release of gas from the cartridge FIG. 12 shows the trigger cap 45 in the released configuration, i.e. the pin member 30 is in the released position. In the released configuration the spring bias member 56 has urged the pin member 30 up against the valve core 60 and has displaced the valve core sufficiently so as to open the valve system to let the compressed gas escape from the cartridge 59. The spring bias member 56 must of course be sufficiently robust so as to overcome any forces opposing the opening of the valve system such as the bias spring of the valve core itself as well as any forces exerted by the pressurized gas which might tend to keep the valve system shut. In this respect it should be kept in mind that the trigger filament must in its own right have sufficient tension strength characteristics which allow it to withstand the tension forces exerted on it by the initially compressed spring bias member 56. Once the valve system is in the open configuration then gas may escape therefrom through the gas openings in the alignment plate and the trigger cap (e.g. openings 41, 38, . . . as shown in detaile in FIG. 6, and openings 50, 51, . . . as shown in detail in FIG. 7) along the gas path represented by the reference numeral 70.

Figure 12:
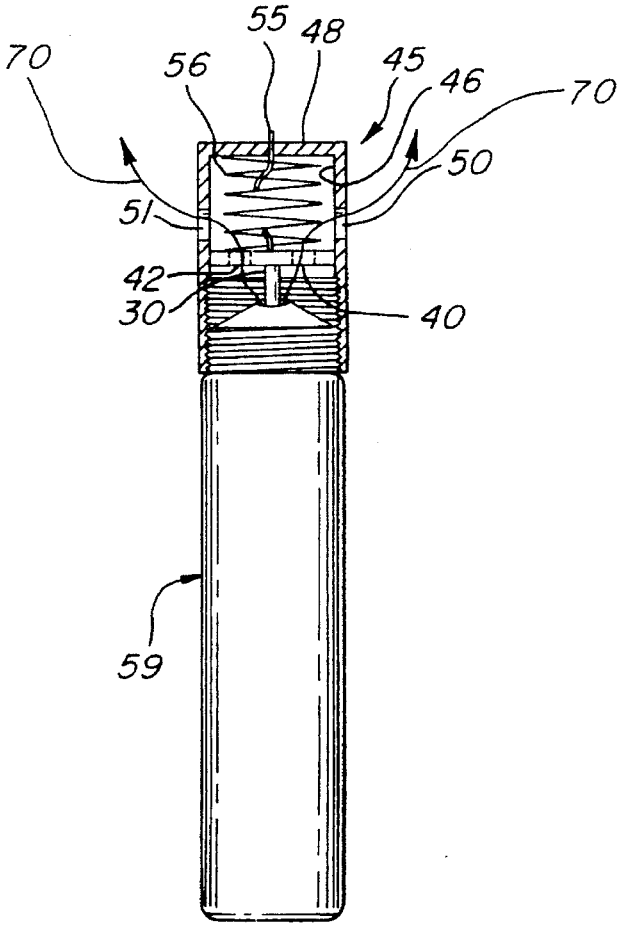
FIG. 12 is a schematic side view of a gas vessel of FIG. 10 to which an activation device of FIG. 7 has been attached, the moveable pin member thereof being in a released position.
Figure 13:
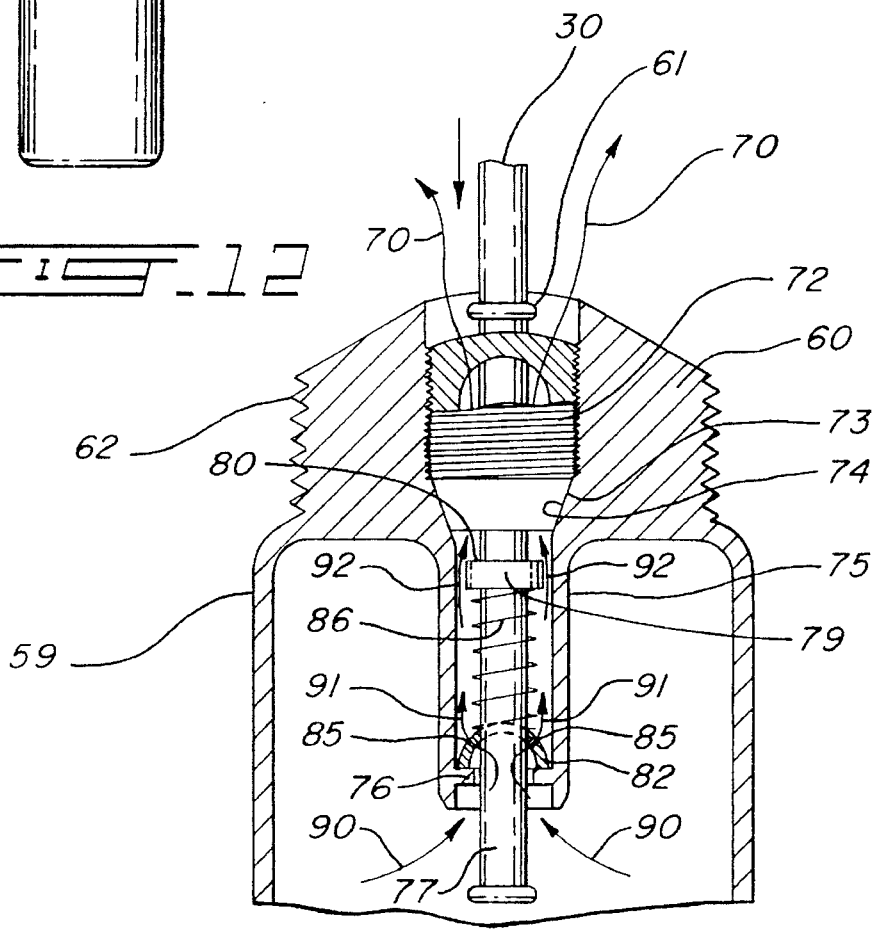
FIG. 13 is a schematic sectional side view of the upper part of a gas vessel of FIG. 10 exposing the moveable valve core which is in a valve open position, the moveable pin member being in an released position.

FIG. 13 is a more detailed illustration of the top part of above mentioned gas cartridge 59 showing the valve system in the open configuration discussed with respect to FIG. 12. The top part of the cartridge 59 has a cylindrical central channel in which is disposed the valve core 60 and a stopper or plug body 72. The central channel has an upper part and a lower part.

The upper part of the channel is provided with an internally threaded surface and beneath the threaded surface is disposed an inwardly inclined ring abutment surface 73. The stopper body 72 has an outer threaded surface and is provide with a lower ring abutment surface 74 having an inclination complimentary to the slope of the abutment surface 73. The upper part of the cartridge channel and the stopper body are sized such that the stopper body 2 may be screwed into the upper part of the cartridge channel; as shown, the stopper body 72 has been screwed into the upper channel such that the surfaces 73 and 74 are urged one against the other into gas tight engagement.

The lower part of the channel is defined by a support member 75 which extends into the interior of the cartridge 59. The support member 75 has ring ridge member 76 which is disposed in spaced apart relation about the lower end 77 of the valve core 60, i.e. so that an annular gas opening or space is defined between the ridge member 76 and the end 77 of the core valve 60.

The stopper body 72 has a central channel disposed therethrough which is sized somewhat larger than the cross section of the valve core 60 so as to define an annular gas channel therebetween. A plug ring ridge member 79 is fixed to the valve core 60. The plug member 79 is configured so as to have a plug surface 80 which is sized so as to be able to be urged up against the bottom of the stopper body 72 for sealing off the adjacent bottom entrance of the annular opening as defined by the valve core 60 and the stopper body 72. At the same time, however, the ring plug 79 has a cross sectional diameter which is sized relative to the interior surface of the lower part of the cartridge channel so as to define an annular channel therebetween. A spring support member 82 is disposed in the lower part of the cartridge channel; this support member 82 is provided with gas openings 85. A bias spring 86 is disposed between and abuts the ring plug 79 and the lower spring support 82; this bias spring will, in the absence of any contrary force, tend to force the valve core 60 upwardly so as to urge the ring plug 79 up against the lower part of the stopper body 72 for closing off in fluid tight fashion the above mentioned annular channel through the stopper body. When the gas cartridge is gas pressurized the ring plug 79 will close of the annular channel in air tight fashion. If desired the bias spring 86 may be configured to directly abut the ridge member 76 so that the support member 82 may be dispensed with, provided of course that gas access to and from the interior of the gas cartridge is possible.

In FIG. 13 the valve system is shown in an opened configuration wherein the ring plug 79 is spaced apart from the bottom of the stopper body 72 due to the urging action of the pin member 30, i.e. the annular channel of the stopper body 72 is no longer blocked by the ring plug 79. As a result the pressurized gas in the cartridge can escape though the valve system. As denoted by the arrows 90, 91, 92 and 70 the gas escapes from the interior of the cartridge by passing through the annular channel defined by the ridge member 76 and the valve core 60 (arrows 90), through the openings 85 in the support member 82 (arrows 91), through the annular channel defined by the ring plug 79 and the interior surface of the lower part of the cartridge channel (arrows 92), through the annular channel defined by the stopper body and the valve core 60 to finally exit the cartridge (arrows 70).

Turning back to FIGS. 1 and 2 a cartridge/trigger cap combination as shown in FIGS. 11, 12 and 13 may be placed entirely within the interior of each of the inflatable chamber 2, 3, 4 and 5 such that the valve system of each of the cartridges is in direct gas communication with the interior of the chambers (see dotted outline of cartridges). Alternatively, of course, only a valve system may be disposed in the interior of a chamber or the valve system may be connected to a chamber by suitable tubing, etc. Additionally, although the vest in FIGS. 1 and 2 is shown with a plurality of cartridges for each chamber, a single cartridge may for example be used with a manifold and appropriate tubing interconnecting the cartridge with each of the chambers; if desired the chambers themselves may be interconnected by tubing to facilitate their inflation from a single gas cartridge.

The vest in FIG. 1 is shown with an activation mechanism 17 which is connected to the trigger filament of each of trigger caps of the cartridge/trigger cap combinations.

Figure 14:
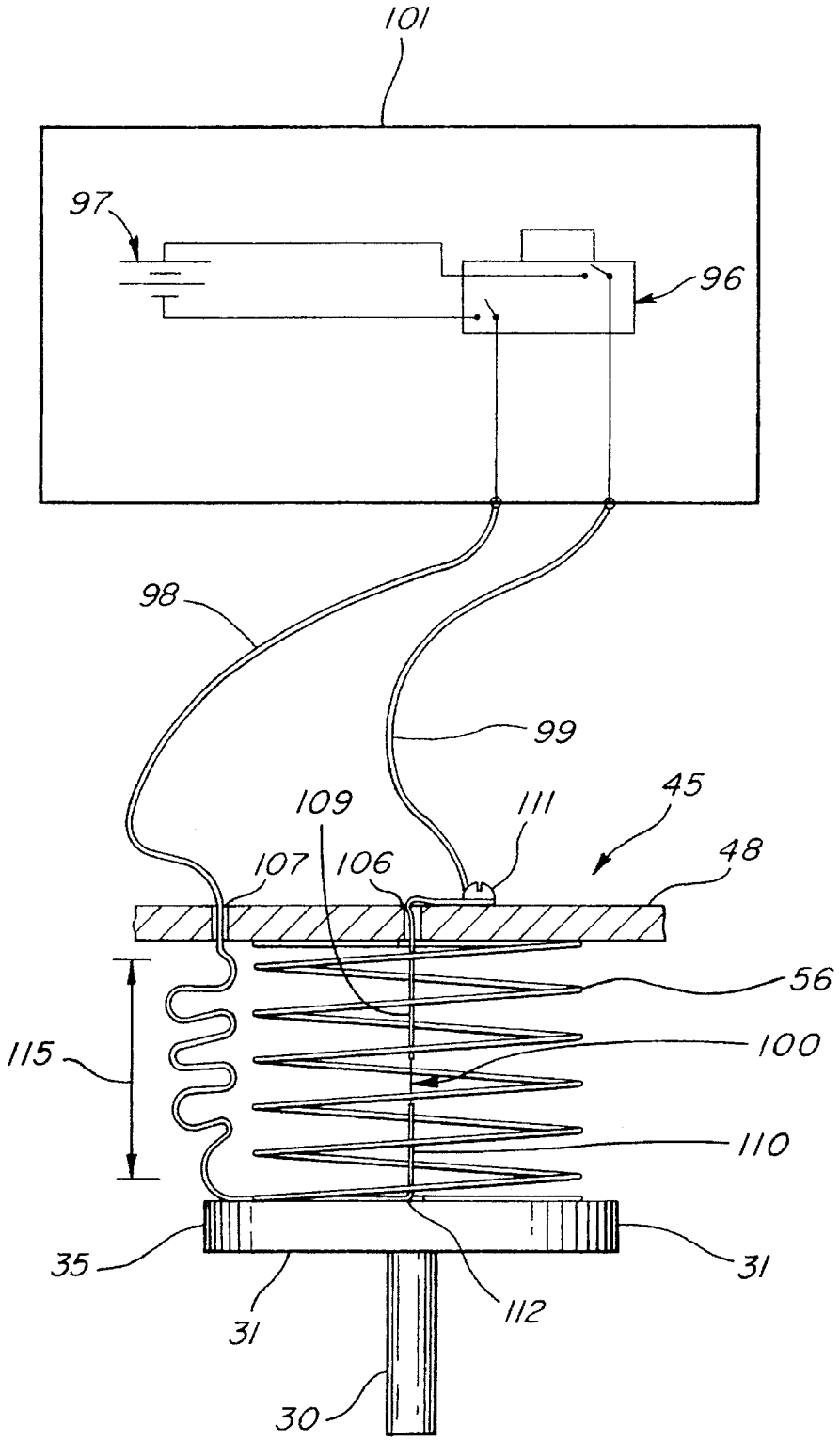
FIG. 14 is a partly schematic, partly block circuit view of an activation device of FIG. 8 electrically attached to an electric trigger circuit.

For discussion purposes only, FIG. 14 shows an example electrical activation mechanism connected to a single trigger cap 45 only part of which is shown. The activation mechanism comprises a single push button switch 96, and one or more battery cells 97. The activation mechanism defines part of an electric circuit. The electric circuit includes the single push button switch 96, the battery cells 97, two wire members 98 and 99 and a tungsten trigger filament 100; the wire members are comprise lengths of insulated water-proof copper wire.

The switch 96 is configured such that the battery cells 97 and the copper wire members 98 and 99 are connected to the switch 96 such that when the switch 96 is open neither wire member 98 nor wire member 99 is electrically connected to a respective terminal of the cells 97. In this manner the tungsten filament 100 may be fully isolated from the cells 97 until such time as desired or predetermined. However, if desired, the switch may be such that one wire member may be directly connected to a respective terminal of the cells 97 while the other is connected through the switch.

When the switch 96 is closed, wire member 98 and wire member 99 are electrically connected to a respective terminal of the cells 97 such that an electric current may flow through the electric circuit including the tungsten filament 100.

As shown the switch 96 and the cells 97 are disposed in a water tight housing 101; the housing 101 may if desired be configured in any suitable way so as to allow access to the interior to insert or replace the switch and/or cells). The wire members 98 and 99 are on the one hand connected to the switch through the housing 101 so as to maintain the water tight integrity of the housing. This may be done in any suitable (known) manner. The wire members may for example be connected to terminals in the housing wall, the terminal as necessary may be waterproofed using any suitable waterproof caulking material; the switch is of course internally connected to these terminals.

The wire members 98 and 99 may similarly be connected to the tungsten filament. As necessary or desired the wire members 98 and 99 may pass in any suitable manner through the wall of a gas chamber (not shown), i.e. the wire members may pass through the wall of the gas tight chambers in gas tight fashion. The wire members 98 and 99 may as necessary or desired be split into two or more parts for gaining access to the interior of the chamber. The passage through a chamber wall may for example be facilitated by the use of water tight male/female connector means; a male connector may be attached to the end of a wire member so as to be able to engage a female connector fixed in water tight fashion to the chamber wall, the female connector being electrically connected to the tungsten filament as described herein for example. Alternatively, a wire member may possibly pass through a chamber wall opening in which is disposed rubber 0-ring or grommet, such grommet engaging the wire member and opening in water tight fashion.

The capping plate 48 has two openings 106 and 107 for the passage of a respective wire member therethrough. The wire member 99 has and end element 109 whereas the wire member 98 has an end element 110. The end element 109 is fixed to the capping plate 48 by being partially wrapped around the threaded stem of retaining screw 111; the head of the screw 111 is screwed tight up against the end element so as to press the end element of the wire member against the plate 48 and to fix the end element in place. The end element 110 is similarly fixed at 112 to the alignment plate 31.

A further pleated portion 115 of the wire member 98 is also disposed between the plates 48 and 31; the length of the pleated portion 115 is such that when the trigger device or cap passes to the released position the wire member 98 will not prevent the pin member 31 from attaining its released position; the opening 107 may also be sized larger than the diameter of wire member 98 such that the wire member 98 may slip through the opening so as not to hinder the movement of the pin 30.

The end elements 109 and 110 are also attached to the tungsten trigger filament 100; the attachment may be by any suitable means such as, for example, by a mechanical pinch squeeze fitting which pinches the parts together with sufficient strength that the end elements 109 and 110 along with the filament 100 define a retaining member which holds the pin member in place against the pushing or biasing action of the spring 56. Alternatively the attachment may be by way of welding such as for example, arc welding. The elements 109 and 110 along with the filament 100 make up the above mentioned retaining member 55 of the example trigger device or cap.

The activation mechanism may initiate inflation of a chamber due to either exterior manual pressure or exterior water pressure being exerted on a pressure displaceable wall member of a housing which in turn allows pressure to be exerted on the push button 96 so as to close the electric circuit (as shall be explained below). Once the electric circuit is closed, an electric current will flow through the tungsten trigger filament 100 causing it to snap-break and free the pin member for movement to the above described released position.

Figure 15:
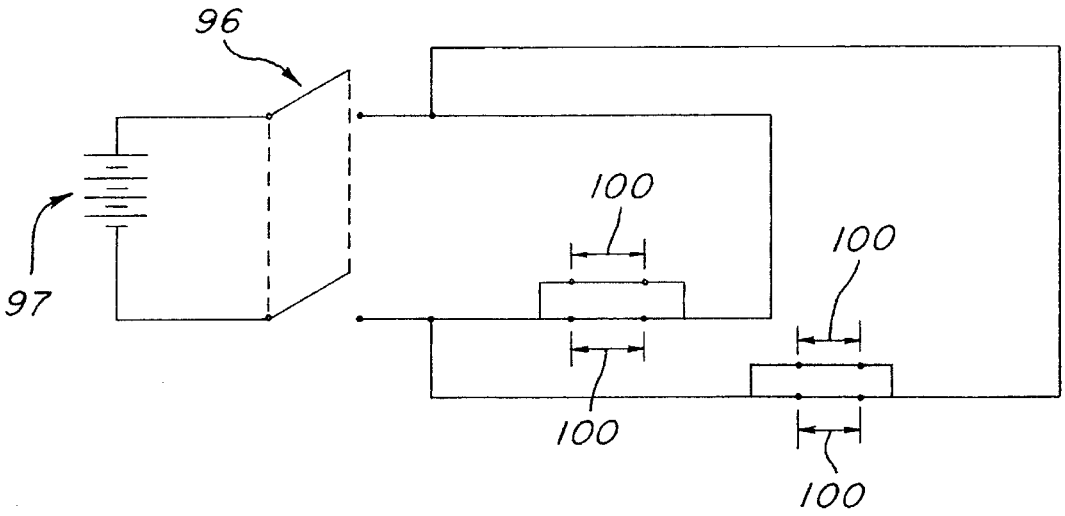
FIG. 15 is a circuit view of an electric trigger circuit including four (4) trigger filaments.

The tungsten filament may, for example, be a tungsten filament which is essentially pure (99.95–98%) and which has a cross sectional diameter of from about 0.015 mm to about 1.4 mm diameter (e.g. 0.1 mm, 0.25 mm, 1.0 mm etc.). The power supply to break such a filament may for example comprise one or more batteries able to deliver a filament breaking current of, for example, for 100 ma to 300 ma for a time sufficient to cause the filament to snap break; e.g. one or more type AA batteries of 1.5 volts each. FIG. 15 schematically illustrates an example electric circuit for an activation mechanism configured to snap-break the trigger filament 100 of four separate cartridge/trigger cap combinations; this setup could for example be used with the vest seen in FIG. 1.

Figure 16:
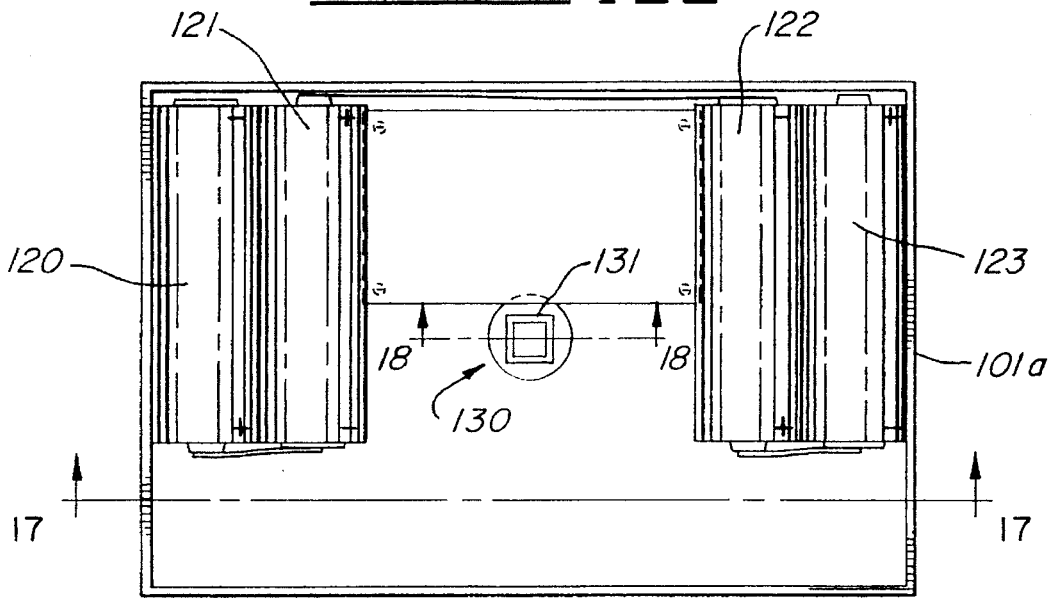
FIG. 16 is a schematic view of a housing having a wall component defining a water tight interior, wherein a trigger switch is disposed in said water tight interior, the pressure displaceable top wall member (e.g. flexible top member) of the wall component being removed.
Figure 17:
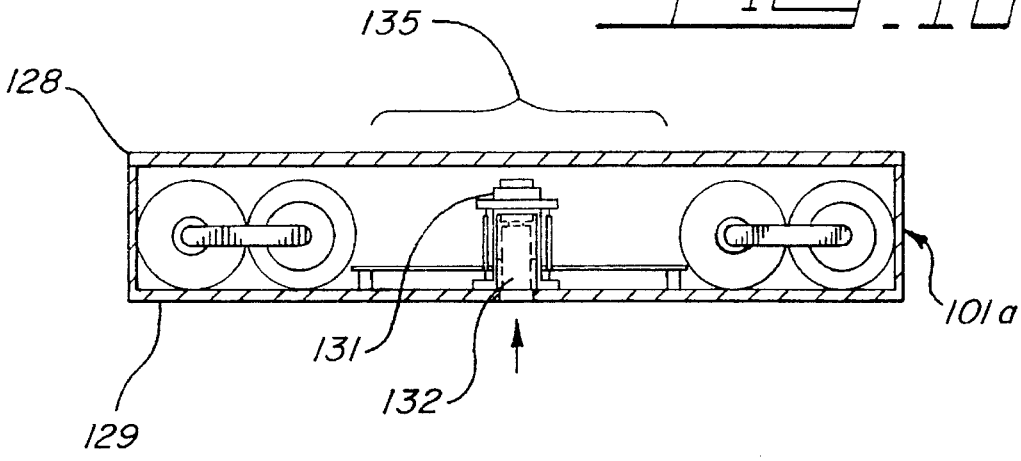
FIG. 17 is a schematic sectional view along 17—17 of FIG. 16.
Figure 18:
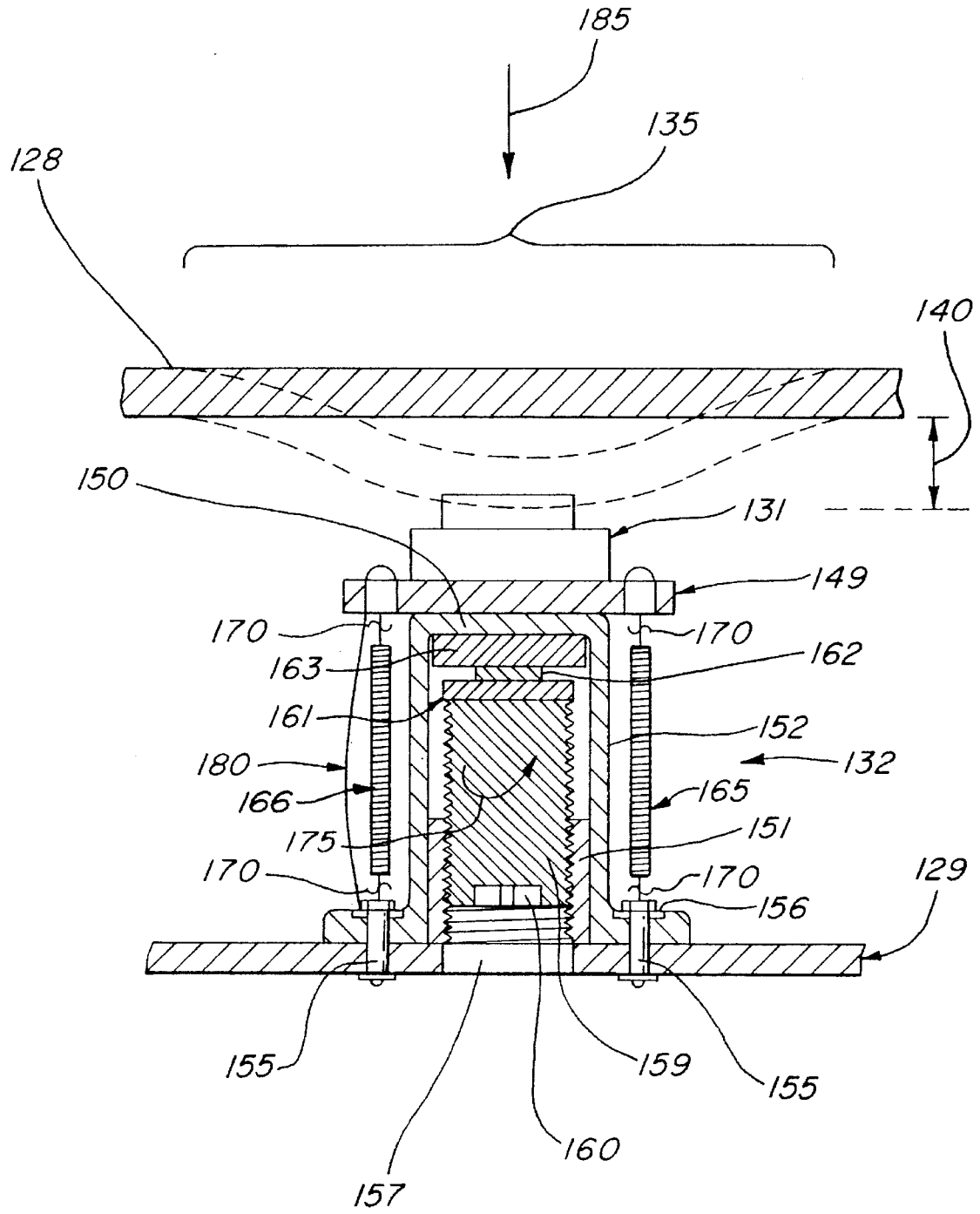
FIG. 18 is a schematic sectional side view along 18—18 of the example embodiment of spacing means of FIG. 16 for altering the predetermined distance between the pressure displaceable wall member and the trigger switch.

FIG. 16, 17 and 18 illustrate an example embodiment of an activation mechanism as shown schematically in FIG. 14; the activation mechanism is provided with a means for varying the pressure which must be applied in order to cause a pressure switch to close the electric circuit for delivering a snap-break electric current to the trigger filament of a trigger cap. This is accomplished by providing a spacing component for varying the distance between a switch and a pressure displaceable wall member or component of the water tight housing 101a. The displaceable wall component is made of a suitable material and is disposed in relation to the switch so as to allow the wall component to be deflected sufficiently such that the wall can abut the switch so as to change the switch from an open to closed configuration. It is to be understood that for a given pressure, the distance which the wall must be displaced, in order for the wall to contact the switch, depends on the nature of the material which makes up the deflectable wall component, i.e. its resistance to deflection; this pressure-distance relationship may be determined on a case by case basis by appropriate evaluation studies of a wall component made of a suitable deflectable (e.g. elastic) material.

For FIGS. 16, 17 and 18 the wiring scheme for electrically connecting the switch to the other elements of the electric activation system are not shown but it may be electrically connected thereto as described herein.

As may be seen from FIGS. 16 and 17 four (4) removable battery cells 120, 121, 122 and 123 are disposed in the water tight housing 101*a*. These cells may be inserted or replaced by providing the housing with one or more removable wall components. The housing has a top wall 128 and a bottom wall 129; the bottom wall is of a more or less rigid type material. The housing includes in the water tight interior thereof a centrally disposed hight adjustable switch combination 130. The hight adjustable switch combination comprises a switch 131 and a stem element 132 of variable length. The switch 131 is disposed above the stem element 132 such that it is spaced apart from an opposed wall portion 135, which as illustrated, is not being subjected to an activation pressure. At least the wall portion 135, of the top wall 128, is of a material which allows the wall portion 135 to be displaced, inwardly toward the switch 131, by an exterior pressure which will cause the wall to engage the switch. If desired, however, the entire top wall 128 may be of such a material.

Referring to FIG. 18, this figure is an enlarged schematic sectional view of the portion of the activation mechanism seen in FIG. 17 which comprises the deformable wall component 135, the switch 131 and the variable length stem element 132. The deformable wall portion 135 is shown as being a distance 140 from the position which it must take in order to activate the switch 131. The deformation of the wall portion 135 to a switch activation position is shown in dotted outline.

The switch 131 is disposed on a platform member 149.

The stem element 132 is essentially of cylindrical configuration and comprises a displaceable engagement member 150, an extension element and a base element 151.

The displaceable engagement member 150 forms the top part of a cylindrical wall element which is made of an elastic or stretchable material. The cylindrical wall element has a cylindrical side wall 152 which is attached at its bottom to the bottom wall 129 of the housing in a water tight fashion; the cylindrical side wall 152 is attached to the wall 129 such that the cylindrical wall element forms part of the water tight wall structure of the housing 17. The bottom of the side wall 152 is shown as being bolted to the wall 129 by plurality of nut/bolt combinations 155 (e.g. 4 symmetrically placed bolt/nut combinations); the bolts bear down tightly on an annular pressure plate 156 which sealingly sandwiches a part of the wall 152 between it and the bottom wall 129. If desired, or necessary, a sealing or chalking material may be applied around the base of the sandwiched part of wall 152 to ensure a fluid tight sealing.

The base element 151 has a screw threaded opening passing therethrough and is fixed (e.g. glued) to the bottom wall 129 around an opening 157 in the wall. The opening 157 provides for access to the central threaded opening in the base element 151.

The extension element comprises a shaft element 159 and a multi-part head element.

The shaft element 159 has an outer surface provided with a screw thread which rotationally engages the screw thread of the base element 151. The bottom of the shaft element 159 is provided with a key opening 160 configured for example for receiving an allen key or the head of a flat end screw driver. An allen key or screw driver may thus be used to rotate the shaft element 159 within the base element 151.

The multi part head element has a base part 161, an intermediate roller bearing part 162 and an upper engagement part 163. The base part 161 is fixed to the shaft element 159. The intermediate bearing part 162 is fixed to the engagement part 163 and rotationally abuts the base part 161 for friction free engagement therewith; the bearing part 162 is configured such that as the base part 161 rotates with the shaft element 159 about the longitudinal axis of the shaft element 159, the bearing elements of the bearing part will rotate in their seats so as to inhibit rotation of the engagement part 163.

As mentioned above the switch 131 is fixed to a platform member 149. Bias springs 165 and 166 are connected to the platform member 149 and to bolts of the bolt/nut combinations 155; such connection may be made in any suitable fashion such as by the complementary hooking system 170 shown in FIG. 18. The bias springs are sized and configured to maintain the platform in abutting contact with the engagement member 150.

Accordingly, as the shaft element 159 is rotated in one direction (i.e. arrow 175) it will move away from opening 157 and in so doing it will urge the switch 131 toward the displaceable wall portion 135 so as to shorten the distance between the wall and the switch and hence reduce the amount of pressure which is needed to be applied to the displaceable wall for bringing it into activation contact with the switch. A rotation in the direction opposite to that of arrow 175 will cause the shaft element to rotate toward opening 157 and in so doing the springs 165 and 166 will urge the switch 131 away from the displaceable wall portion 135 so as to lengthen the distance between the wall and the switch and hence increase the amount of pressure which needs to be applied to the displaceable wall for bringing it into activation contact with the switch.

A limiting filament 180 may if desired be provided in order to limit the degree of displacement of the switch 131 by the extension element in the direction of the displaceable wall portion, i.e. to stop the extension element from displacing the switch 131 to the point wherein the switch 131 abuts up against the wall portion. The filament 180 may be fixed in any suitable manner to the platform 149 and the wall part 129 (e.g. by screws, glue, welding or the like).

In FIG. 18 the arrow 185 shows the direction of application of a pressure (manual or water) from the exterior side of the housing 17 which is needed to displace the wall member 135 to the position shown in dotted outline.

If desired a depth gradient may be disposed about the above mentioned opening 157 on the outer surface of the wall 129. A pointer marking may also be disposed on the exposed end of the stem shaft element 159. The gradient and pointer marking are configured such that the disposition of the pointer relative to the gradient is indicative of the depth at which the system will automatically induce inflation of the flotation chambers; essentially the depth gradient will correspond to a specific distance between the switch and the pressure displaceable wall member. With such a gradient a user may alter the factory set depth setting to a setting of choice by rotating the shaft element such that the pointer marking lines up with the indication on the gradient indicative of the desired depth of inflation.

Figure 19:
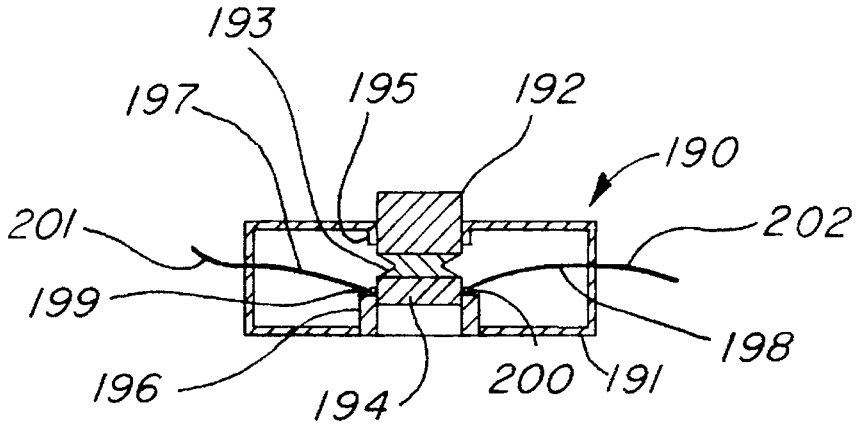
FIG. 19 is a schematic sectional side view of an example switch able to remain locked in a closed position, the switch being shown in an open configuration.
Figure 20:
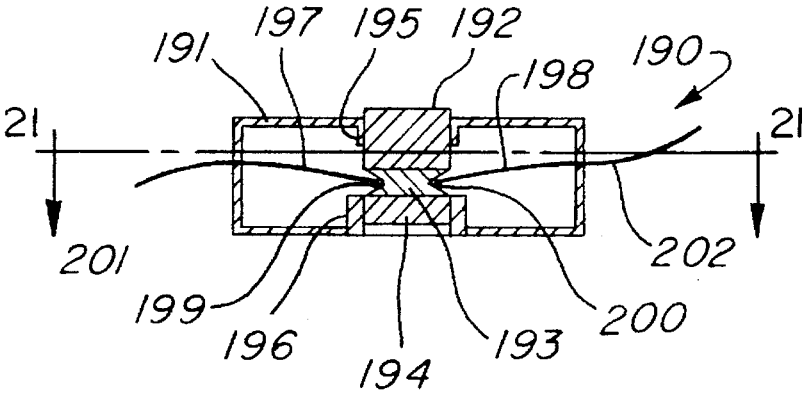
FIG. 20 is a schematic sectional side view of the switch of FIG. 19, the switch being shown in an closed configuration.
Figure 21:
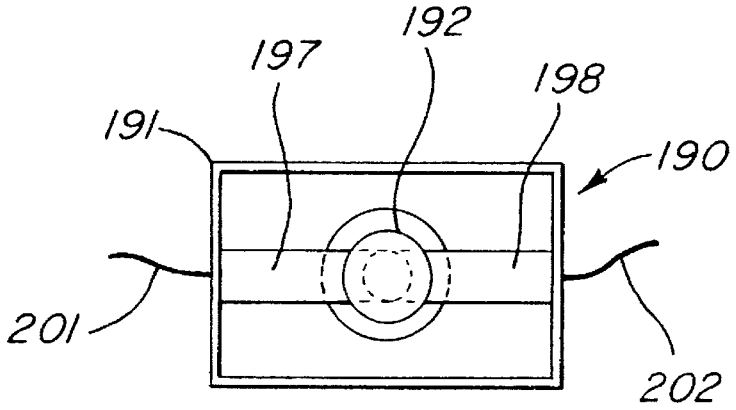
FIG. 21 is a sectional top view along 21-21 of the switch shown in FIG. 20.

As mentioned above, the pressure responsive switch may be of a type configured to remain closed once it has been displaced to the closed configuration. FIGS. 19, 20 and 21 illustrate by way of example the general form which such a switch may take. The switch 190 has a housing 191 in which is disposed push button comprising an upper part 192, intermediate part 193 and lower part 194. The housing 191 and button parts 192 and 194 are of an electrically non-conductive material; the intermediate button part 193 however is of an electrically conductive material. The upper and lower button parts frictionally engage upper and lower channel members 195 and 196 defined by the housing 141; the frictional engagement between these elements is such that a predetermined downwardly exerted pressure on the button will displace the button from the switch open position shown in FIG. 19 to the switch closed position shown in FIG. 20. The intermediate button part 193 defines an annular groove about the button.

The switch 190 includes electrically conductive band members 197 and 198. These band members are configured and disposed so as to have a spring like character such that as the button passes from the open to closed position the ends 199 and 200 snap into place into respective portions of the groove defined by the intermediate button part 193. Once the ends 199 and 200 are disposed in this groove the button is locked into the closed position.

The switch includes electrical wires 201 and 202 for connecting the switch to the desired electric circuit.

An activation mechanism of the present invention may be attached to a life jacket or analogous device in any suitable manner keeping in mind the function of the activation mechanism. An activation mechanism such as shown in FIGS. 16 and 17 may be more or less integral with the outer surface of a life jacket or be connected to the jacket by some type of umbilical cord means which may also serve as part of the means whereby the activation mechanism is electrically connected to a trigger mechanism as described herein.

The water tight housing 17 (FIG. 16) may for example be of a clam shell type which may have pivotable covering means which may be pivotable between an open configuration for allowing access to the interior of the housing for replacement of the battery cells and a closed fluid tight configuration during use.

Referring now to FIGS. 23 to 33, these figures illustrate advantageous modified members of an activation mechanism as described above. To the extent that FIGS. 23 to 33 show elements which are common with the previously described members, the same reference numerals will be used with reference thereto; the different elements will be hereinafter described in more detail.

Figure 22:
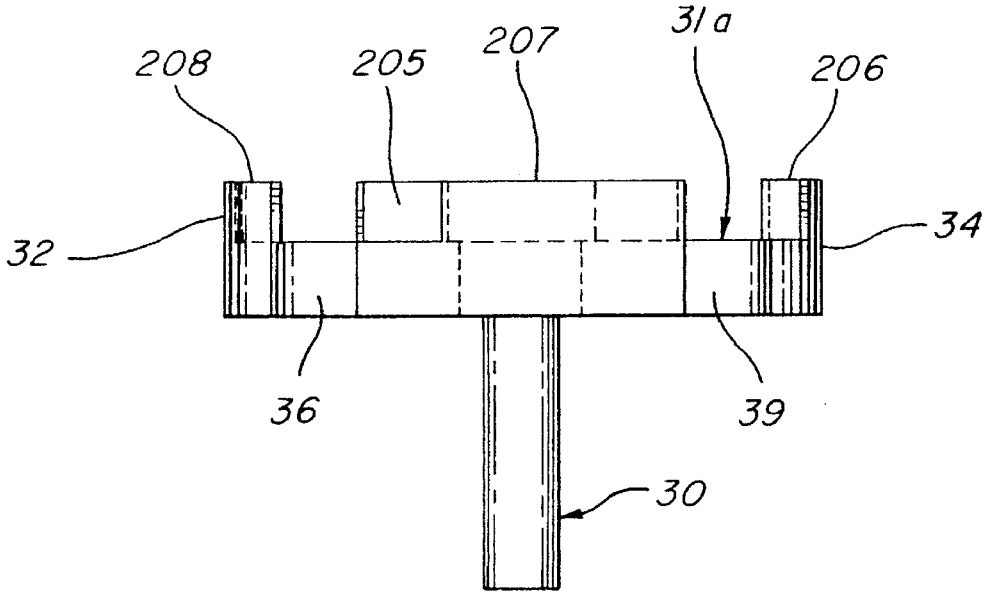
FIG. 22 is a side view of another example embodiment of an activation pin member attached to a capping alignment plate.
Figure 23:
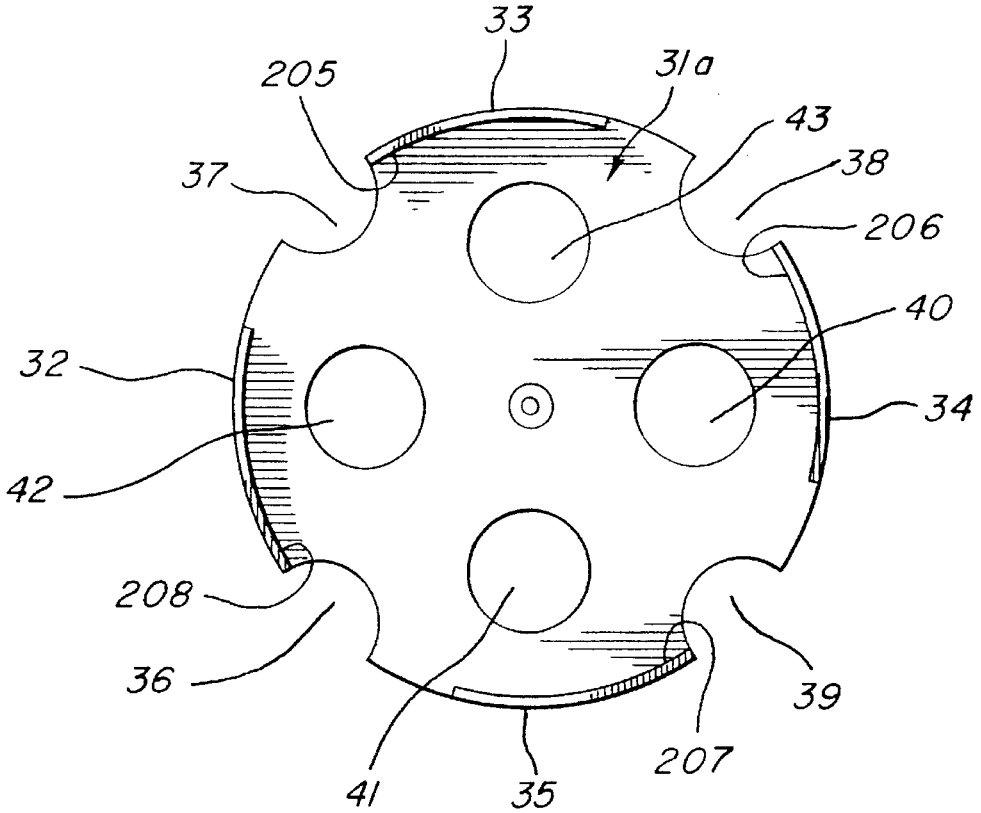
FIG. 23 is a top view of the alignment plate attached to the activation pin member of FIG. 22.

Referring to FIGS. 22 and 23, these figures show an activation pin member 30 fixed to a cylindrical alignment plate 31*a* which includes alignment projections 205, 206, 207 and 208. These alignment projections effectively increase the side surface area of the side walls 32 to 35 of plate 31a which are to slidably engage the interior surface 46 of the trigger cap 45 and thus augment the alignment characteristics of these side walls in relation to the interior surface 46 of the trigger cap 45 (see for example FIGS. 8 and 9). The same effect could of course be achieved by increasing the overall thickness of the plate 31a at least around the periphery thereof; the larger surface of the side walls will inhibit binding of the plate 31a in the trigger cap 45.

Figure 24:
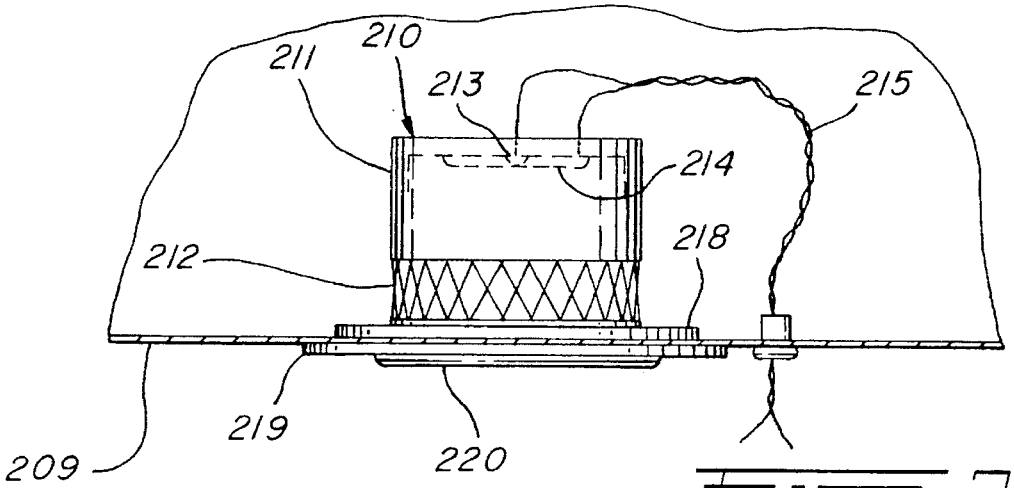
FIG. 24 is a partial cut away view of a flotation chamber provided with a socket attachment member configured for releasably attaching an activation or trigger device to the chamber whereby a gas vessel connected to the activation device may be brought into gas communication with the interior of the chamber.
Figure 25:
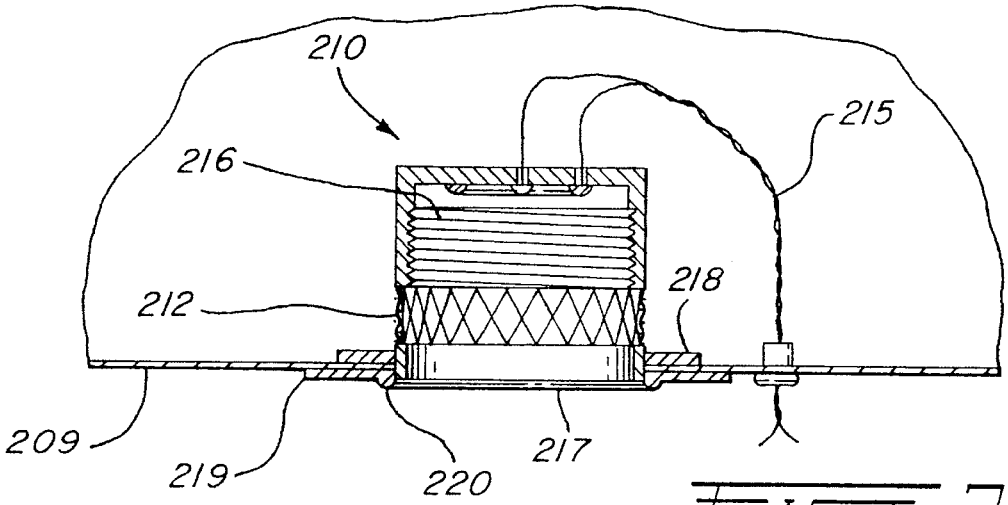
FIG. 25 is a sectional side view of the socket attachment member as shown in FIG. 24.
Figure 26:
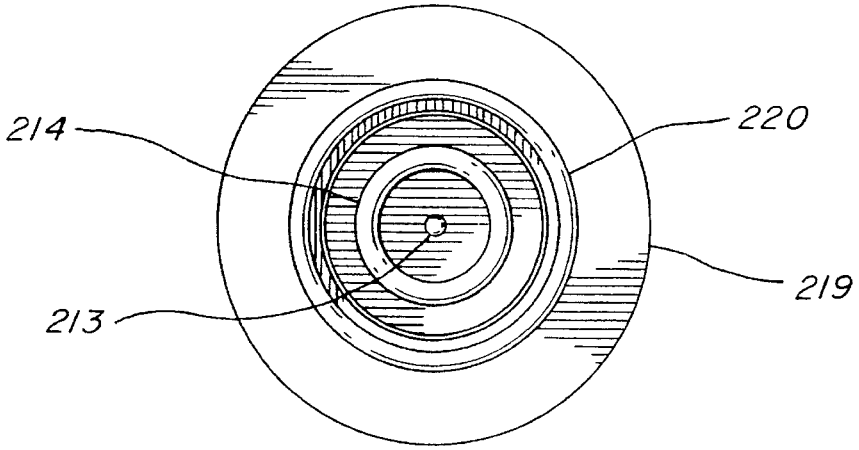
FIG. 26 is a bottom view of the socket attachment member as shown in FIG. 24.
Figure 27:
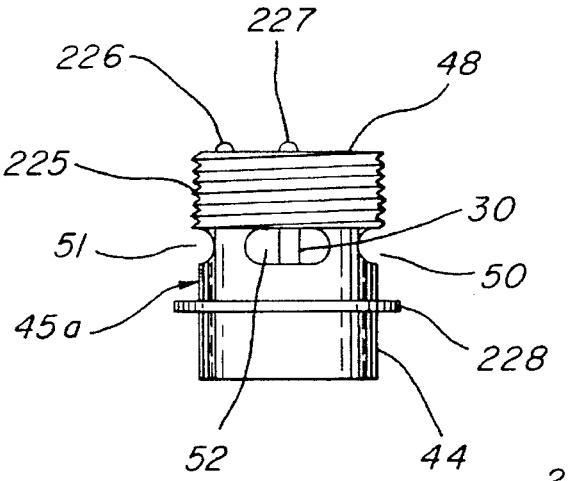
FIG. 27 is a schematic side view of another example embodiment of an activation device in accordance with the present invention configured to engage the socket attachment member of FIG. 24.
Figure 28:
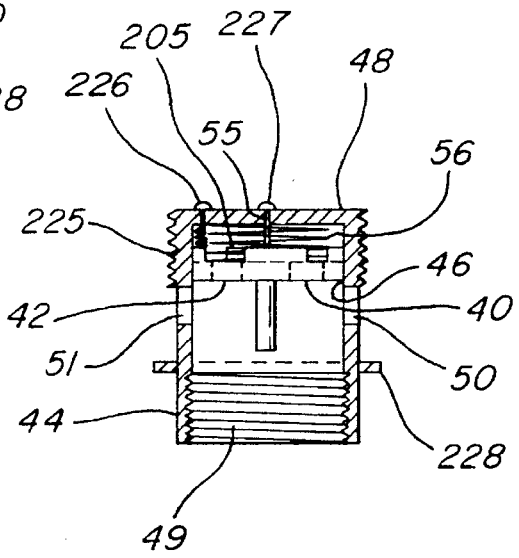
FIG. 28 is a schematic sectional side view of the activation device of FIG. 27 with the moveable pin member thereof in an armed position.
Figure 29:
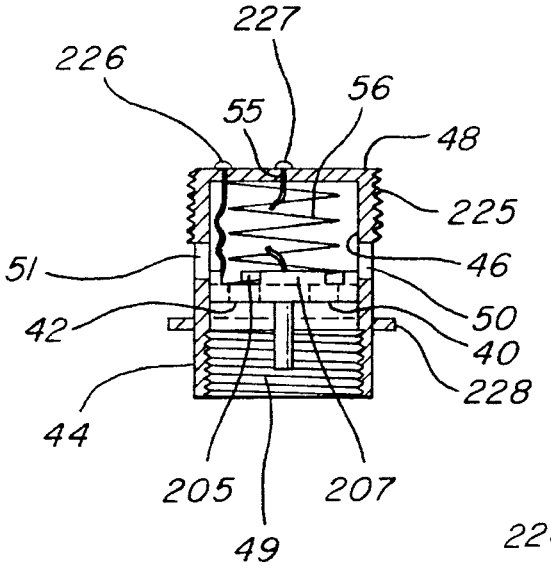
FIG. 29 is a schematic sectional side view of the activation device of FIG. 27 with the moveable pin member thereof in a released position.

Turning to FIGS. 24, 25 and 26, these figures illustrate a means whereby a modified trigger device or cap 45*a* (as shall be described below with respect to FIGS. 27 to 30) and the related gas storage vessel (e.g. a gas cartridge 59 as seen in FIG. 10) may be releasably connected to an inflatable gas chamber such that a life jacket for example may be reused simply by replacing the trigger device and gas vessel (the gas chamber in this case will of course be deflated prior to attaching the new trigger cap and gas vessel to the life jacket). As seen in these figures, the wall 209 of an inflatable gas chamber is provided with a socket attachment member 210. The socket member 210 is an example element of a gas communication member for gas communication between a gas storage vessel and an inflatable chamber; the valve system of FIG. 13 may form another example element of such gas communication member. The body 211 of the socket attachment member 210 is disposed on the interior side of the chamber. The body 211 includes a grill portion 212 which defines openings which allow for gas communication between the interior and exterior of the body 211. The body 211 is provided with interior electrical contacts 213 and 214 which are each connected to a respective wire element of an electric wire 215 comprising two separate wire elements (i.e one defining wire member 98 and the other defining wire member 99 mentioned above).

The interior of the body 211 is sized and configured to receive the trigger device or cap 45*a* shown in FIGS. 27 to 30 which shall be described below. The upper interior part of the body 211 is provided with interior screw threads 216; the lower part of the body 211 has an opening 217 for providing access to the interior of the body 211 from the exterior of the chamber. The socket attachment member 210 is fixed in fluid tight fashion to the wall of the chamber by the interior annular ring member 218 and the exterior annular lip member 219. The members 218 and 219 are tightly clamped together by a plurality of screw/nut members (not shown) such that the portion of the wall of the chamber disposed therebetween is compressively sandwiched therebetween in fluid tight fashion. The member 219 includes an annular sealing gasket member 220. The wire 215 is passed through the wall of the chamber in any suitable fluid tight fashion; the opening through which the wire 215 passes may be rendered fluid tight for example by the application of a suitable caulking material around the wire 215 and in the opening therefor.

FIGS. 27 to 30 show a modified trigger device or cap 45a which is essentially the same as the trigger device 45 shown in FIGS. 7 to 9. The variation shown in FIGS. 27 to 30 however does have a number of differences which facilitate the mating screw engagement between the socket member 210 (FIG. 24) and the modified trigger device **45*a*. The modified trigger device 45*a* as shown in these figures has exterior screw threads 225. The modified trigger device 45*a* also is provided with electrical contacts 226 and 227 which are connected to a tungsten filament in a fashion analogous to that as shown in FIG. 14. As may be understood by referring back to FIG. 14, the electrical contact 226 is connected to a short end element of the wire member 98 which comprises wire end element 110; the electrical contact 227 is connected to a short end element of wire member 99 which comprises the wire end element 109. The trigger device includes an annular sealing lip 228**.

Figure 31:
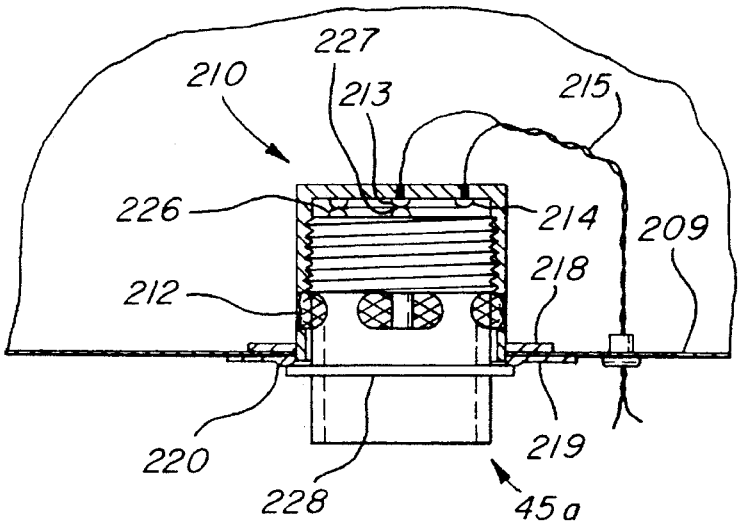
FIG. 31 is a sectional side view of the socket attachment member as shown in FIG. 24 with the activation device of FIG. 27 attached thereto.

Referring to FIG. 31, this figure shows the trigger device **45*a* in screw engagement with the socket member 210. The trigger device 45*a* is of course configured and sized so as to be able to be screwed into the interior of the socket body 210 so as to have a screw engagement between the interior threads 216 (see FIG. 25 for more detail) and the exterior threads 225 (see FIG. 27 for more detail). The trigger device 45*a* and the body 210 are also sized such that the lip 228 may be pressed hard up against the sealing gasket member 220 so as to provide a fluid tight seal around the gasket member 220**.

Figure 30:
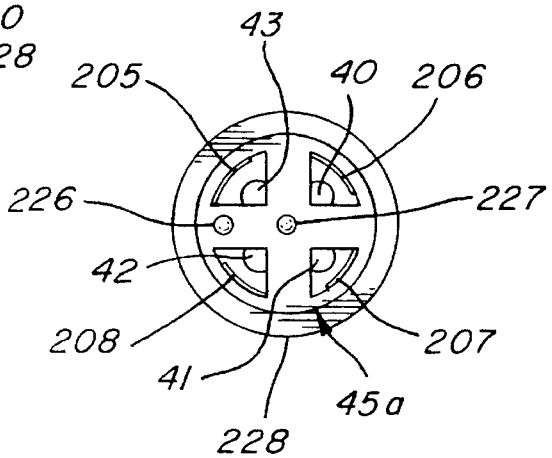
FIG. 30 is a top view of the attachment device shown in FIG. 27.

Referring to FIG. 30 the modified trigger device **45*a* is shown with openings in the plate 48** which have the shape of a sector of a circle.

Although FIGS. 24 to 33 show how the modified trigger device **45*a* may be releasably connectable directly to a single chamber, the trigger device 45*a*** may, if desired, for example, be connected in analogous fashion to a manifold member configured for the distribution of gas to a plurality of separate gas inflatable chambers.

Figure 32:
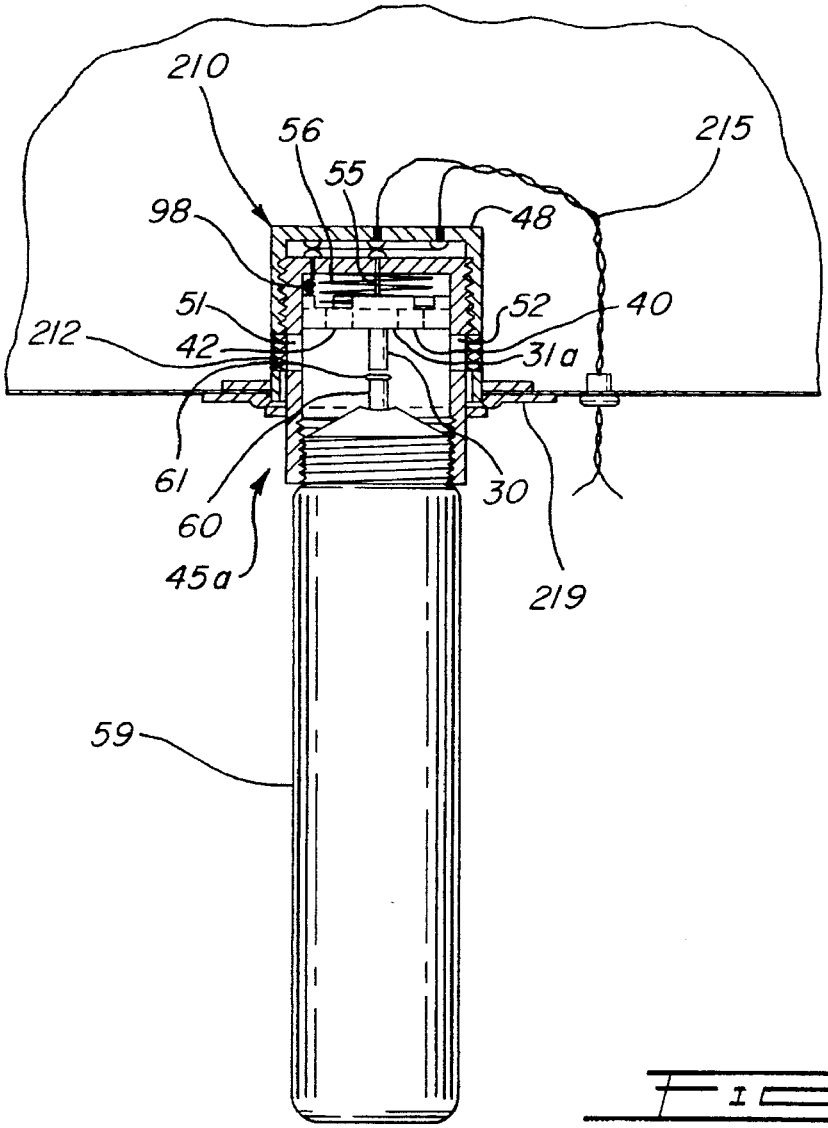
FIG. 32 is a sectional side view of the socket attachment member and the activation device as shown in FIG. 31 wherein a gas vessel is attached to the activation device.

FIG. 32 shows a gas vessel 59 screwed fluid tight into the trigger device 45. The system is shown in an armed state. The air in the vessel may pass into the interior of the chamber through the trigger cap openings such openings 51 and 52, as well as through the openings of the grill portion 212.

Figure 33:
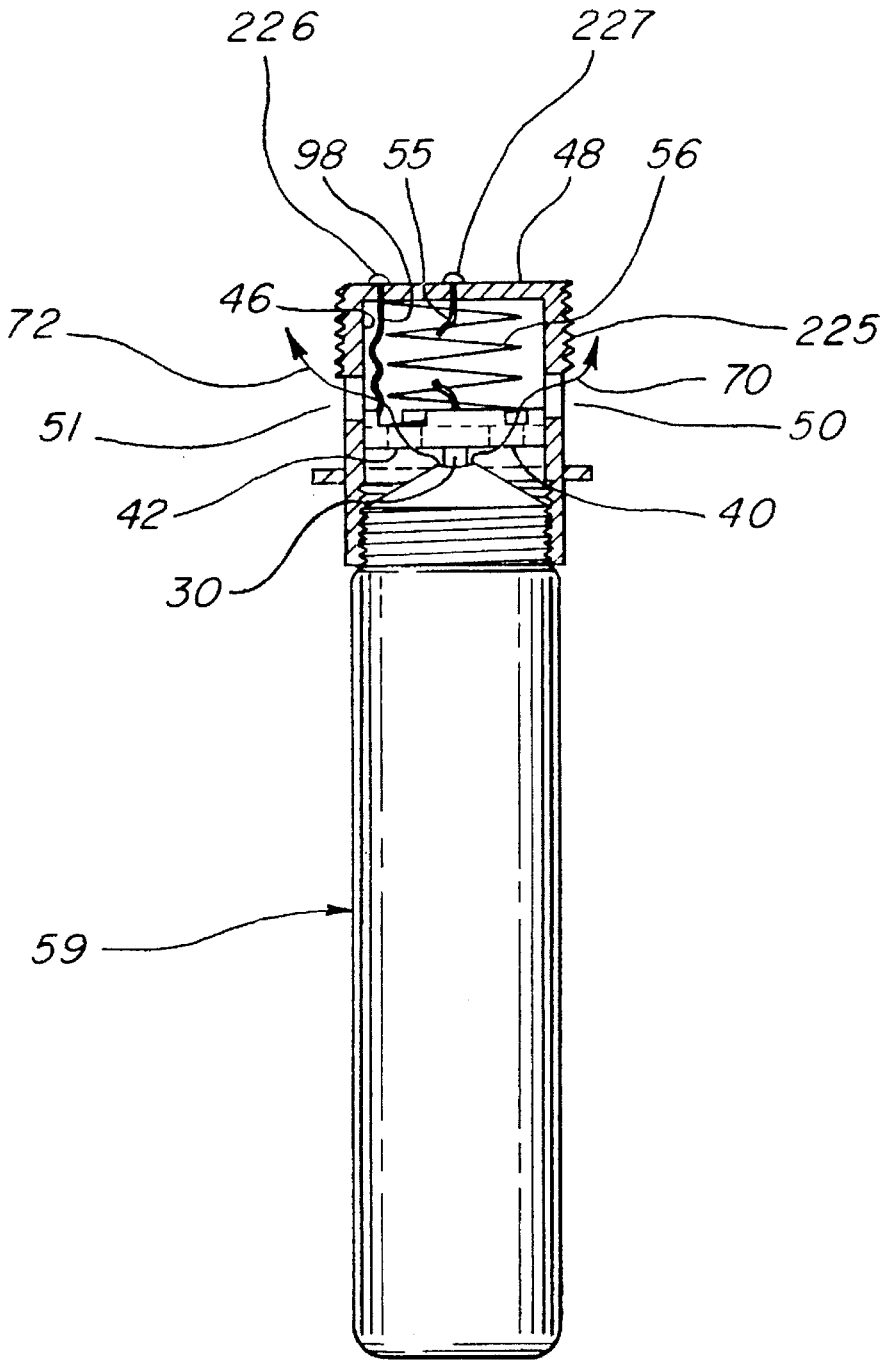
FIG. 33 is a schematic side view of the attached gas vessel and activation device as shown in FIG. 32 wherein the moveable pin member thereof is in a released position, the attachment device being shown in sectional side view.

FIG. 33 illustrates the trigger device 45a and gas cartridge 59 in a gas release configuration with the gas leaving along the gas path 270; the socket member 210 and chamber are not shown for illustration purposes. The gas path 270 would of course include a portion defined by the openings of the grill member 212.

I claim:

1. A trigger device comprising an anchor component, an alignment component, an activation pin member displaceable between an armed position and a released position, a trigger filament fixed to said anchor component and to said activation pin member for releaseably maintaining said activation pin member in said armed position, and a biasing component for maintaining said trigger filament under tension when said activation pin member is in said armed position, said biasing component engaging said activation pin member, said alignment component being configured to guide said activation pin member from said armed position to said released position, said trigger filament being configured and disposed so as to be able to define a portion of an electric circuit such that when said trigger filament is maintained under tension in said armed position by said biasing component a predetermined electric current passing therethrough will cause the trigger filament to snap-break, said alignment component and said biasing component being configured and disposed such that when said trigger filament is broken by passage of said electric current therethrough said biasing component is able to urge said activation pin member to said released position.

2. A trigger device as defined in claim 1 wherein said trigger filament comprises a tungsten filament.

3. An inflation system for the inflation of an inflatable flotation device wherein a gas is chargeable into a gas inflatable chamber from a gas vessel containing compressed gas so as to form a floatable body, said inflation system comprising a gas inflation component, a gas inflatable chamber component, and a water resistant electric circuit component, said electric circuit component comprising power supply means for supplying electric power to said circuit, and a pressure responsive electric switch component comprising a switch, said switch component being configured such that a predetermined pressure is able to displace the switch between an open configuration wherein electric current is not able to flow through said circuit and a closed configuration wherein electric current is able to flow through said circuit, said gas inflation component comprising a trigger device, a gas vessel containing compressed gas, a gas communication member for gas communication between said gas vessel and said gas inflatable chamber component, said gas communication member comprising a valve having a valve core displaceable between a valve open position and a valve closed position, said valve core being biased in said valve closed position, said trigger device comprising an anchor component, an alignment component, an activation pin member displaceable between an armed position and a released position, and a tensioned trigger filament fixed to said anchor component and to said activation pin member releaseably maintaining said activation pin member in said armed position, said alignment component being configured to guide said activation pin member from said armed position to said released position, said trigger filament being maintained under tension by a biasing component engaging said activation pin member, said trigger filament defining a portion of said electric circuit component such that a predetermined electric current passing therethrough will cause the filament to snap-break, said alignment component and said biasing component being configured and disposed such that when said trigger filament is broken by passage of said electric current therethrough said biasing component is able to urge said activation pin member to said released position whereby said activation pin element engages and displaces said valve core from said valve closed position to said valve open position so as to release said gas from said gas vessel for inflation of said gas inflatable chamber component.

4. An inflation system as defined in claim 3 wherein said trigger filament comprises a tungsten filament.

5. An inflation system as defined in claim 4 wherein said switch component comprises a switch housing defining a water tight interior, and wherein said switch is disposed in said water tight interior, said housing having a pressure displaceable wall member having a first configuration wherein said pressure displaceable wall member is disposed a predetermined distance from said switch, said pressure displaceable wall member and said switch being disposed and configured such that a predetermined exterior pressure is able to displace said pressure displaceable wall member from said first configuration to an activation configuration whereby the pressure displaceable wall member engages and displaces the switch from said open to said closed configuration thereof.

6. An inflation system as defined in claim 5 wherein said inflation system includes a spacing component for altering said predetermined distance between said pressure displaceable wall member and said switch.

7. An inflation system as defined in claim 6 wherein said switch is fixed to a platform member, and wherein said spacing component comprises a stem element of variable length fixed to said switch housing, said stem element having a displaceable engagement member forming part of said wall component, said platform member engaging said displaceable engagement member, the length of said stem element being variable such that an increase in the length of the stem member will induce a corresponding reduction of said predetermined distance and a decrease in the length of the stem element will induce a corresponding increase of said predetermined distance.

8. An inflation system as defined in claim 7 wherein said stem element comprises an extension element and a base element, said extension element and said base element being disposed outside of said water tight interior, said base element being fixed to said switch housing, said base element comprising an opening extending therethrough, said opening being provided with an internal screw thread, said extension element comprising a head element and a shaft element, said shaft element having an external screw thread for rotatable engagement with said internal screw thread, said extension element and said base element being disposed and configured such that said head element engages said displaceable engagement member such that said engagement member is disposed between said head element and said platform member and wherein said spacing component includes means for rotation of said extension element, relative to said base element, whereby the length of said stem member may be increased or decreased.

9. An inflation system as defined in claim 8 wherein said power supply means is disposed in the said water tight interior of said switch housing.

10. An inflation system as defined in claim 3 wherein said power supply means is disposed in the said water tight interior of said switch housing.

11. An inflation activation system for the inflation of an inflatable flotation device wherein a gas is chargeable into a gas inflatable chamber from a gas vessel containing compressed gas so as to form a floatable body, said inflation activation system comprising a housing defining a water tight interior a water resistant electric circuit component, and pressure responsive activation means for activating a gas inflation component for the inflation of a gas inflatable chamber, said pressure activation means being disposed in said water tight interior, said housing having a pressure displaceable wall member having a first configuration wherein said pressure displaceable wall member is disposed a predetermined distance from said pressure responsive activation means, said pressure displaceable wall member and said pressure responsive activation means being disposed and configured such that a predetermined exterior pressure is able to displace the pressure displaceable wall member from said first configuration to an activation configuration whereby the pressure displaceable wall member engages said pressure responsive activation means so as to activate said gas inflation component for the inflation of said gas inflatable chamber, said electric circuit component comprising power supply means for supplying electric power to said circuit, and said pressure responsive activation means, said pressure activation means comprising a pressure responsive electric switch component comprising a switch, said switch component being configured such that a predetermined pressure is able to displace the switch between an open configuration wherein electric current is not able to flow through said circuit and a closed configuration wherein electric current is able to flow through said circuit, said gas inflation component being configured so as to be activatable when electric current is able to flow through said circuit, said pressure displaceable wall member and said switch being disposed and configured such that a predetermined exterior pressure is able to displace said pressure displaceable wall member from said first configuration to an activation configuration whereby the pressure displaceable wall member engages and displaces the switch from said open to said closed configuration thereof.

12. An inflation activation system as defined in claim 11 wherein said inflation activation system includes a spacing component for altering said predetermined distance between said pressure displaceable wall member and said switch.

13. An inflation activation system as defined in claim 12 wherein said switch is fixed to a platform member, and wherein said spacing component comprises a stem element of variable length fixed to said switch housing, said stem element having a displaceable engagement member forming part of said wall component, said platform member engaging said displaceable engagement member, the length of said stem element being variable such that an increase in the length of the stem member will induce a corresponding reduction of said predetermined distance and a decrease in the length of the stem element will induce a corresponding increase of said predetermined distance.

14. An inflation activation system as defined in claim 13 wherein said stem element comprises an extension element and a base element, said extension element and said base element being disposed outside of said water tight interior, said base element being fixed to said switch housing, said base element comprising an opening extending therethrough, said opening being provided with an internal screw thread, said extension element comprising a head element and a shaft element, said shaft element having an external screw thread for rotatable engagement with said internal screw thread, said extension element and said base element being disposed and configured such that said head element engages said displaceable engagement member such that said engagement member is disposed between said head element and said platform member and wherein said spacing component includes means for rotation of said extension element, relative to said base element, whereby the length of said stem member may be increased or decreased.

* * * * *